US010040618B2

(12) United States Patent
Nevo

(10) Patent No.: US 10,040,618 B2
(45) Date of Patent: Aug. 7, 2018

(54) INFLATED PACKAGE, PRECURSOR AND METHOD

(71) Applicant: Airguard Ltd., Ein HaMifratz (IL)

(72) Inventor: Shlomo Nevo, Tel-Aviv (IL)

(73) Assignee: Airguard Ltd., Ein HaMifratz (IL)

( * ) Notice: Subject to any disclaimer, the term of this patent is extended or adjusted under 35 U.S.C. 154(b) by 585 days.

(21) Appl. No.: 14/364,719

(22) PCT Filed: Dec. 12, 2012

(86) PCT No.: PCT/IB2012/057244

§ 371 (c)(1),
(2) Date: Jun. 12, 2014

(87) PCT Pub. No.: WO2013/088372

PCT Pub. Date: Jun. 20, 2013

(65) Prior Publication Data

US 2014/0328551 A1 Nov. 6, 2014

Related U.S. Application Data

(60) Provisional application No. 61/569,302, filed on Dec. 12, 2011.

(51) Int. Cl.

| | |
|---|---|
| ***B65D 81/05*** | (2006.01) |
| ***B65B 1/04*** | (2006.01) |
| ***B65B 51/10*** | (2006.01) |
| ***B65D 33/00*** | (2006.01) |

(52) U.S. Cl.

CPC ..... *B65D 81/052* (2013.01); *B65B 1/04* (2013.01); *B65B 51/10* (2013.01); *B65D 33/00* (2013.01)

(58) Field of Classification Search

CPC ..... B65D 81/052; B65D 33/00; B65D 81/05; B65D 81/051

USPC ..... 206/522; 383/3

See application file for complete search history.

(56) References Cited

U.S. PATENT DOCUMENTS

| | | | |
|---|---|---|---|
| 4,017,351 | A | 4/1977 | Larson et al. |
| 4,240,556 | A | 12/1980 | Field |
| 5,263,587 | A | 11/1993 | Elkin et al. |
| 5,420,556 | A | 5/1995 | Okazaki |
| 5,427,830 | A | 6/1995 | Pharo |
| 5,445,274 | A | 8/1995 | Pharo |
| 5,469,966 | A | 11/1995 | Boyer |

(Continued)

FOREIGN PATENT DOCUMENTS

| | | |
|---|---|---|
| CA | 2381938 | 8/2000 |
| CH | 703963 | 4/2012 |

(Continued)

OTHER PUBLICATIONS

Supplementary Partial European Search Report (Rule 164(1) EPC) dated Jun. 29, 2015 From the European Patent Office Re. Application No. 12856617.1.

(Continued)

*Primary Examiner* — Steven A. Reynolds

(57) ABSTRACT

Inflated packages custom-designed to meet the needs of a variety of packaging needs, package precursors (i.e., packages in an un-inflated state), and methods for forming package precursors and converting package precursors into finished packages. Nozzle and needle inflated embodiments are included.

22 Claims, 23 Drawing Sheets

(56) References Cited

U.S. PATENT DOCUMENTS

| | | | | | |
|---|---|---|---|---|---|
| 5,570,788 | A * | 11/1996 | Batsford | B65D 81/052 | 206/522 |
| 5,588,532 | A | 12/1996 | Pharo | | |
| 5,620,069 | A | 4/1997 | Hurwitz | | |
| 5,620,096 | A | 4/1997 | Pozzo | | |
| 5,762,197 | A * | 6/1998 | Farison | B65D 81/052 | 206/522 |
| 5,769,231 | A * | 6/1998 | Batsford | B65D 81/052 | 206/522 |
| 6,056,119 | A | 5/2000 | Risgalla et al. | | |
| 6,213,167 | B1 | 4/2001 | Greenland | | |
| 6,244,440 | B1 * | 6/2001 | Tschantz | B65D 81/052 | 206/521 |
| 6,276,532 | B1 | 8/2001 | Sperry et al. | | |
| 6,283,296 | B1 | 9/2001 | Newman | | |
| 6,398,029 | B1 * | 6/2002 | Farison | B65D 81/052 | 206/522 |
| 6,513,974 | B2 * | 2/2003 | Malone | B65D 81/052 | 206/522 |
| 6,520,332 | B1 * | 2/2003 | Barmore | B65D 81/052 | 206/497 |
| 6,571,954 | B2 | 6/2003 | Nadler | | |
| 6,598,373 | B2 | 7/2003 | Sperry et al. | | |
| 6,629,777 | B2 * | 10/2003 | Tanaka | B65D 33/02 | 206/522 |
| 7,168,566 | B2 | 1/2007 | Anderson et al. | | |
| 7,220,476 | B2 * | 5/2007 | Sperry | B31D 5/0073 | 206/522 |
| 7,223,461 | B2 * | 5/2007 | Kannankeril | B31D 5/0073 | 206/522 |
| 7,823,729 | B2 | 11/2010 | Lee | | |
| 7,874,428 | B2 | 1/2011 | Kojima et al. | | |
| 8,745,960 | B2 | 6/2014 | Kannankeril et al. | | |
| 9,764,862 | B2 | 9/2017 | Borgeat et al. | | |
| 2005/0100251 | A1 | 5/2005 | Havens et al. | | |
| 2006/0218879 | A1 | 10/2006 | Garceau et al. | | |
| 2007/0295633 | A1 | 12/2007 | Liao et al. | | |
| 2012/0000807 | A1 * | 1/2012 | Scarbrough | A45C 7/0081 | 206/522 |
| 2016/0122112 | A1 | 5/2016 | Nevo et al. | | |

FOREIGN PATENT DOCUMENTS

| | | |
|---|---|---|
| EP | 2632706 | 9/2013 |
| FR | 2456677 | 12/1980 |
| WO | WO 2012/055053 | 5/2012 |
| WO | WO 2013/088372 | 6/2013 |
| WO | WO 2014/199368 | 12/2014 |

OTHER PUBLICATIONS

International Preliminary Report on Patentability dated Dec. 23, 2015 from the International Bureau of WIPO Re. Application No. PCT/IL2014/050403.

Communication Pursuant to Article 94(3) EPC dated Oct. 13, 2016 From the European Patent Office Re. Application No. 12856617.1.

International Preliminary Report on Patentability dated Jun. 26, 2014 From the International Bureau of WIPO Re. Application No. PCT/IB2012/057244.

International Search Report and the Written Opinion dated Aug. 26, 2014 From the International Searching Authority Re. Application No. PCT/IL2014/050403.

Supplementary European Search Report and the European Search Opinion dated Nov. 9, 2015 From the European Patent Office Re. Application No. 12856617.1.

Communication Pursuant to Rule 114(2) EPC dated Mar. 24, 2015 From the European Patent Office Re. Application No. 12856617.1.

International Search Report and the Written Opinion dated May 7, 2013 From the International Searching Authority Re. Application No. PCT/IB2012/057244.

Communication Pursuant to Article 94(3) EPC dated May 17, 2017 from the European Patent Office Re. Application No. 12856617.1 (6 Pages).

Communication Pursuant to Article 94(3) EPC dated Jul. 18, 2017 from the European Patent Office Re. Application No. 14729057.1. (6 Pages).

Restriction Official Action dated Dec. 26, 2017 From the U.S. Patent and Trademark Office Re. U.S. Appl. No. 14/890,624. (8 pages).

Official Action Dated May 2, 2018 From the US Patent and Trademark Office Re. U.S. Appl. No. 14/890,624. (29 pages).

* cited by examiner

400

400

INFLATED PACKAGE, PRECURSOR AND METHOD

RELATED APPLICATIONS

This application is a National Phase of PCT Patent Application No. PCT/IB2012/057244 having International filing date of Dec. 12, 2012, which claims the benefit of priority under 35 USC § 119(e) of U.S. Provisional Patent Application No. 61/569,302 filed Dec. 12, 2011. The contents of the above applications are incorporated herein by reference in their entirety.

FIELD OF THE INVENTION

The present invention in some embodiments thereof relates to the field of packaging, and more particularly, to inflated packages, package precursors (i.e., packages in an un-inflated state), and methods for forming package precursors and to converting package precursors into finished packages.

BACKGROUND ART

Various packing materials are known in the art, including rigid blocks of polyurethane and polystyrene foam, and foam beads. There are also many examples of inflatable packaging materials. Representative of these are the following U.S. patent documents:

U.S. Pat. Nos. 4,240,556; 6,056,119; 5,588,532; 5,620,069; 6,598,373; 5,420,556; 5,445,274; 6,283,296; 6,571,954; 7,168,566; 7,823,729; 7,874,428; and 5,620,096; and U.S. published application 2006/0218879.

Inflated packaging materials have some known advantages. For example, such packaging materials can be stored flat or on rolls and occupy little space before inflation. Likewise, the inflated portions can be deflated after use, for example, by cutting or puncturing, and again occupy little space.

Inflated packages are generally recyclable, and are advantageous in countries and localities that impose strict environmental rules on disposal of packaging materials. Foam packaging materials are generally not recyclable.

SUMMARY OF THE INVENTION

As noted above, the term "package precursor" is used herein to refer to a package in its un-inflated state. The term "package" or "inflated package" is used to refer to a package after inflation of the precursor. The terms "cushion" or "panel" are used interchangeably to refer to individual inflated sections. The term "area" is used to refer to inflatable and un-inflatable parts of a package precursor, as well as to the inflated and un-inflated parts if the package itself.

According to an aspect of some embodiments of the present invention, there is provided a precursor for an inflated package having a first plurality of article-receiving areas defined by inflatable areas and non-inflatable areas, and a second plurality of sealable inflation ports connected to the inflatable areas and connectable to a source of inflation by one of a third plurality of inflation manifolds on the precursor, and to an inflated package formed from such a precursor.

According to an aspect of some embodiments of the present invention, there is provided a precursor for an inflated package having a plurality of inflatable areas that are inflatable to form panels that can be folded and at least partially wrapped around packaged articles, fold lines forming hinge areas between adjacent panels one or more sealable inflation ports connected to the inflatable areas and connectable to a source of inflation and connecting passages between upstream and downstream panels, in which the connecting passages are inwardly tapered from their respective upstream ends toward their downstream ends, and to an inflated package formed from such a precursor.

According to an aspect of some embodiments of the present invention, there is provided a precursor for an inflatable package having a plurality of inflatable areas that form panels that can be folded and at least partially wrapped around packaged articles, one or more sealable inflation ports connected to the inflatable areas and connectable to a source of inflation, hinge areas between adjacent panels, and connecting passages between upstream and downstream panels and to the inflation ports, and in which the inflated panels are self-folding, and to an inflated package formed from such a precursor.

According to an aspect of some embodiments of the present invention, there is provided a precursor for an inflated package having one or more un-inflatable areas, one or more inflatable areas, and one or more sealable inflation ports connected to the inflatable areas and connectable to a source of inflation by one or more inflation manifolds on the precursor, which are stored on rolls or flat sheets before inflation, and in which the upstream ends of the inflation manifolds are configured to facilitate insertion of an inflation nozzle for manual or machine inflation.

According to an aspect of some embodiments of the present invention, there is provided an inflatable precursor for a foldable package having a plurality of inflatable areas that define foldable panels in an inflated package, and a plurality of un-inflatable hinge areas between the foldable panels, in which the inflatable areas are arranged transversely relative to a longitudinal line of symmetry.

According to an aspect of some embodiments of the present invention, there is provided an inflatable precursor for a foldable package as just described in which some of the inflatable areas are oriented longitudinally relative to a transverse line of symmetry, and in which at least two inflatable areas are oriented transversely at opposite ends of the longitudinally extending inflatable areas, and to an inflated package formed from such a precursor.

According to an aspect of some embodiments of the present invention, there is provided a precursor for an inflated package having one or more article-receiving areas defined by inflatable and non-inflatable areas, and perforations defining a border between portions of the precursor that are inflated when the package is formed and surrounding scrap material, so that the package-forming portion of the precursor and the scrap material can be separated before, during, or after inflation, and to an inflated package formed from such a precursor.

According to an aspect of some embodiments of the present invention, there is provided a precursor for an inflated package having one or more article-receiving areas defined by inflatable and non-inflatable areas and one or more sealable inflation ports connected to the inflatable areas and connectable to a source of inflation fluid by one or more inflation manifolds on the precursor, in which the article-receiving areas are arrayed longitudinally and transversely on the precursor, and in which there are separate inflation manifolds on opposite longitudinal edges of the precursor connected to inflation ports for inflation of adjacent article-receiving areas.

According to an aspect of some embodiments of the present invention, there is provided a precursor for an inflated package having multiple article-receiving panel areas defined by inflatable areas and non-inflatable areas arrayed longitudinally on a flat sheet or a roll, in which longitudinally adjacent panel areas are configured differently to form top and bottom covers for a packaged article, and to an inflated package formed from such a precursor.

According to an aspect of some embodiments of the invention, there is provided a package precursor having an article-receiving area defined by an inflatable area and an un-inflatable area within the margins of the inflatable area, and an inflation port within the margins of the un-inflatable area, in which the inflation port includes an inlet area connectable to a source of inflation fluid, and a sealable connecting passage between the inlet area and the inflatable area, and to an inflated package formed from such a precursor.

According to an aspect of some embodiments of the invention, there is provided an inflated package having a plurality of un-inflated areas, a plurality of inflated area that least partially surround at least some of the un-inflated areas, and one or more sealed inflation ports though which inflation fluid is provided to the inflated areas when an un-inflated precursor for the package is inflated, and in which the inflation fluid is one or more of argon, SF6, propane, butane, freons, hydro fluoro carbons (HFC), and a combination of fluids that react to form a foam.

The embodiments of the package precursors and inflated packages described above include at least one of the features described below:

i) an inflatable area at least partially surrounds an un-inflatable area, or inflated and un-inflated areas in an inflated package;

ii) inflatable or inflated areas are connected in series or in parallel by the connecting passages, and one or more of the inflatable or inflated areas includes an article-receiving area defined by an inflatable and an un-inflatable area or by inflated and un-inflated areas in an inflated package;

iii) a single inflation port provides inflation fluid to all the inflatable or inflated areas in an inflated package;

iv) separate inflation ports provide inflation fluid to more than one or more, but not all the inflatable or inflated areas;

v) inflatable or inflated areas not directly connected to an inflation port are connected in series to an upstream inflatable and/or inflated areas by a connecting passage;

vi) at least some of the inflatable and/or inflated areas not directly connected to an inflation port are connected in parallel to an upstream inflatable area by a connecting passage;

vii) the fold lines of precursors for foldable packages are formed by hinges comprised of un-inflatable areas defined by marginal bond lines or bonded areas;

viii) the inflation manifolds are located along opposite edges of the package precursor;

ix) the article-receiving areas are defined by non-inflatable areas within which articles are received, and include bottom and/or top and surfaces within the margins of surrounding inflatable or inflated areas;

x) the panel areas include un-inflatable shaping areas to help assure the desired shape for the panels upon inflation;

xi) the article-receiving areas are configured to receive an article to be packaged between top and bottom surfaces through an opening in the surrounding inflated areas;

xii) the article-receiving areas have no top or bottom surfaces;

xiii) the packaged article is within the article-receiving area before the precursor has been inflated;

xiv) the packaged article is not in the article-receiving area when the precursor is being inflated;

xv) margins of the article-receiving areas are configured to match the contours of at least a portion of an article to be received therein;

xvi) the precursor and the package are formed from polymer sheeting comprised of two or more layers of polymer film or an extruded sleeve having bonds in selected areas to define margins of inflated and un-inflated areas and inflation passages;

xvii) the layers are formed by a single folded sheet of polymer film;

xviii) the polymer film is comprised of laminated layers of polyethylene and polyamide;

xix) at least one of the polymers includes an additive selected according to requirements of the article to be packaged;

xx) the additive provides anti-static or anti-corrosive properties for a package formed from the precursor;

xxi) the additive includes a preservative for perishable foods;

xxii) some of the inflatable areas are sealed from each other to form two or more separate inflated compartments;

xxiii) the two sheets of film in the article-receiving areas are not bonded together, and the spaces between the two sheets are inflated in the package to provide a cushion under the packaged article;

xxiv) the precursor and the inflated package includes sealable inflation ports separate from the inflation ports through which other parts of the precursor and package are inflated for inflating the cushion;

xxv) the thickness of the polymer sheets is in the range of about 25 to about 400 microns;

xxvi) the connecting passages vary in width from about 23-24 mm at their upstream ends down to about 12-14 mm at their downstream ends;

xxvii) the precursor is foldable along the line of symmetry, and opposing edges parallel to the line of symmetry are bonded together when an inflated package is formed from the precursor;

xxviii) the hinge areas and the inflatable areas are configured so that a package formed from the precursor is foldable to about 90 degrees along the line of symmetry to cover a corner of an article;

xxix) the precursor includes separate inflation manifolds on opposite longitudinal edges connected to inflation ports for inflation of adjacent inflatable areas;

xxx) the ends that are perpendicular to the line of symmetry are un-bonded to form the inflated package as a sleeve;

xxxi) one of the ends that is perpendicular to the line of symmetry includes an un-bonded area that is short compared to the width of the inflated package to form a partial closure for the end of the package;

xxxii) opposing edges at one end that are perpendicular to the line of symmetry are bonded together to form the bottom of a bag when an inflated package is formed from the precursor;

xxxiii) an end of a bag opposite the bottom includes flaps that are sealable to provide an air-tight enclosure for the top of the bag to protect a packaged article from exposure to the environment when an inflated package is formed from the precursor;

xxxiv) the end opposite to bottom of the bag includes inflatable areas that are configured differently from other panels so that a package formed from the precursor self-closes, but do not seal, the package;

xxxv) the package precursor and the package include a fastener arrangement configured to close the open end of the bag;

xxxvi) the fastener arrangement is comprised of hook and eye elements;

xxxvii) the inflation ports are sealed by a bond line or by a valve;

xxxviii) the precursor is configured so that projections of a packaged article are in contact with an un-inflated area in the package;

xxxix) the precursor includes one or more un-inflatable areas forming chambers configured to receive projections of a packaged article in an inflated package;

xl) the precursor is configured to at least partially self-separate from scrap during inflation;

xli) the inflatable areas and the inflated areas of a package formed from the precursor on one face of the precursor and package are different than those on the opposite face;

xlii) the inflatable areas on the one face are larger than those on the oppose face, whereby the inflated areas on a package extend outwardly from a plane of the package further on the one side;

xliii) the inflatable areas on the one face are staggered transversely or longitudinally relative to those on the opposite face so that the inflated areas of the packages interleave when placed in an outer container;

xliv) the precursor includes inflatable and un-inflatable areas that form handles at the top ends of inflated bags;

xlv) the inflatable handle-forming areas surround the un-inflatable areas, and the surrounded un-inflatable areas are configured to be removed before, during, or after inflation;

xlvi) the width of the connecting passages a very narrow compared to the length of the panels, and/or the width of the hinge areas is substantially greater than the width of the connecting passages between the panels and/or the connecting passages are inwardly tapered from respective upstream ends toward their downstream ends;

xlvii) the angle of self folding varies from about 180 degrees to about 90 degrees as the width of the hinge areas decreases;

According to an aspect of some embodiments of the invention, there is provided method for forming an inflatable package from polymer sheeting in which a precursor for the package is formed with a plurality of inflatable areas in the sheeting that define article-receiving areas, a plurality of inflation ports are formed on the precursor connected to the inflatable areas, one or more inflation manifolds are formed on the precursor for connecting the inflation ports to a source of inflation fluid, and the inflation ports are sealed after use.

Embodiments of the method just described include at least one of the following features:

xlviii) top and bottom surfaces are formed in the article-receiving areas;

xlix) openings are formed in the inflatable areas to provide access to the article-receiving areas for insertion of packaged articles between the top and bottom surfaces;

l) articles are inserted into the article-receiving areas before the precursors are inflated;

li) articles are inserted into the article-receiving areas after the precursors are inflated;

lii) the sheeting is formed by bonding two or more layers of polymer film together, or by folding a single sheet of polymer film, or using an extruded polymer sleeve;

liii) a plurality of panel areas and connecting passages between at least some panel areas are formed on the precursor, and some of the panel areas receive inflation fluid from an upstream panel area during inflation;

liv) the connecting passages are formed with an inward taper from their respective upstream ends toward their downstream ends;

lv) non-inflatable hinges are formed between the panel areas so the inflated panels can be at least partially folded around an article in an inflated package;

lvi) perforations are formed on the precursor for separating an inflated package from scrap material;

lvii) a plurality of article-receiving areas are formed in one more columns extending longitudinally on the polymer sheeting; and separate inflation manifolds are formed for inflation of adjacent areas;

lviii) substantially all of the portions of the precursor forming the inflation manifolds are removed from the package before, during, or after inflation;

lix) at least some of the inflatable areas symmetrically oriented relative to a line of symmetry, the precursor is folded before, during or after inflation, the contacting edges parallel to the line of symmetry are bonded, and one of the edges perpendicular to the line of symmetry is bonded to form a bag;

lx) a separate inflation port is formed for each inflatable area having an inlet area and a connecting passage between the inlet area and the inflatable area, and the connecting passage is sealed after inflation;

lxi) the precursor is inflated by inserting a needle into the inlet areas of the inflation ports;

lxii) multiple panel areas are inflated simultaneously through separate inflation ports;

lxiii) one or more panel areas are inflated to different pressures than others.

According to an aspect of some embodiments of the invention, there is provided a precursor for an inflatable package having an array of article-receiving panel areas, that are defined by inflatable areas surrounding un-inflatable areas, an inflation point configured to accommodate entry of an inflation needle and perforations surrounding each article receiving area that allow the article-receiving areas to be separated from each other and surrounding scrap material, and to packages formed by inflation of such a precursor.

In some embodiments, the un-inflatable areas are separated from the inflatable areas by bond lines.

In some embodiments, the inflation points are sealed after use by spot welding, or by an internal one-way valve, or by an adhesive sticker placed over a needle-receiving opening.

In some embodiments, the un-inflated area forms a recess configured to receive the packaged article.

In some embodiments, the un-inflated area is configured as a pocket for receiving the packaged article.

In some embodiments, the un-inflated area the article-receiving areas include a further inflatable area within the un-inflatable area, and separate inflation points for each inflatable area configured to accommodate entry of an inflation needle.

According to an aspect of some embodiments of the invention, there is provided an inflatable precursor having a plurality of inflatable panel areas configured to be folded around, and to at least partially cover the bottom, top, sides, and one end of a packaged article, a further inflatable panel area configured to be folded to cover the other end of the packaged article, an un-inflatable flap configured to overlie the further inflatable panel to protect the further inflatable panel from damage by a sharp projection of a packaged article, and to a package formed by inflation of the precursor.

In some embodiments, tabs projecting from the flap and from the further panel area that are sealed to each other to secure the flap and the further panel area together.

In some embodiments, the plurality of panel areas and the further panel area are comprised in two separate compartments.

In some embodiments, a single inflation port is provided for inflating both compartments.

In some embodiments, the single inflation port is comprised of an inlet, and branches that form inflation paths for the two compartments.

In some embodiments, the two branches of the inflation port are sealed by a single welded bond on a package formed by inflation of the precursor.

In some embodiments, there are connecting passages between the plurality of panel areas.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. Before describing the drawings in detail, it is stressed that the particulars shown are by way of example and for purposes of illustrative discussion of some of the many embodiments of the invention. In this regard, the description taken with the drawings will make apparent to those skilled in the art how embodiments of the invention may be practiced.

In the drawings.

DESCRIPTION OF EMBODIMENTS OF THE INVENTION

Figure 1:
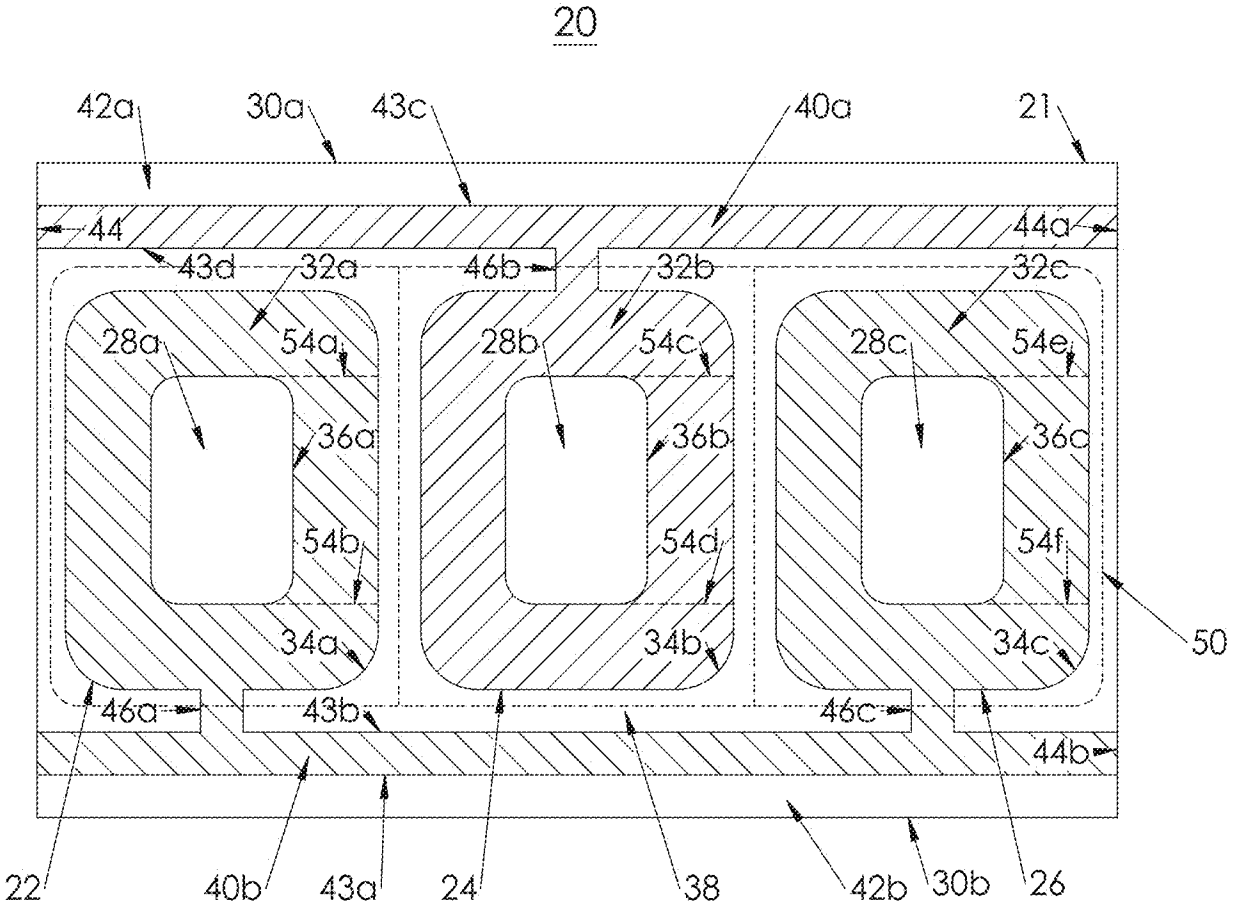
FIG. 1 is a schematic view, seen generally from above, of an exemplary package embodiment in its un-inflated (precursor) state.

The present invention, in some embodiments thereof, relates to the field of packaging, and more particularly, to inflated packages, package precursors (i.e., un-inflated packages), and methods for forming package precursors and converting package precursors into finished packages.

Generally, some embodiments of the invention pertain to inflatable package precursors that are defined by un-inflatable and inflatable areas that at least partially surround some of the un-inflatable areas in which the inflatable areas are inflated through one or more inflation passages (referred to herein as "inflation ports") connected by one or more inflation manifolds to a source of inflation fluid, and to inflated packages formed from such precursors.

Some embodiments of the invention pertain to inflatable package precursors as described herein, in which scrap material is removed before inflation, or alternatively, during or after inflation. Optionally, substantially all the material forming the inflation manifolds is removed from the package after inflation.

Optionally, according to some embodiments, perforations are provided on the package precursors by which it or the inflated package is separated from scrap material. Optionally, the scrap is separated from the precursor by forces resulting during the process of inflation. Optionally, if the inflated package remains attached to the surrounding scrap material at a few points, it can easily separated manually. Optionally, the scrap material is removed by a cutting die.

Typically, the inflation fluid is compressed air. Optionally other gasses such as nitrogen, $CO_2$, argon, SF6, propane, butane, freons, and hydro fluoro carbons (HFC) may be used. Optionally, a combination of gasses may be used. Optionally, one or more areas may be inflated by a combination of foam-forming fluids, for example, a monomer with at least two isocyanate functional groups with another monomer with at least two hydroxyl or alcohol groups that react in the presence of a catalyst to form polyurethane foam. Optionally, some parts can be inflated with foam and others by compressed air or other gas, to by a combination of gasses. Some uses of gasses other than compressed air and foam forming fluids are described below.

Optionally, the inflation pressure is in the range of about 0.15 to about 0.35 kg/square cm, for example, about 0.3 kg/square cm, depending on the size and shape of an article to be packaged. For example, greater pressures can provide greater resilience and or more protection.

Optionally, the inflation fluid in the package can be frozen after inflation.

Some embodiments of the invention pertain to foldable package precursors and inflated packages having a plurality of inflatable areas that form panels or cushions when inflated and are configured to be wrapped around at least parts of a packaged article upon inflation. Optionally, the inflatable panel areas are connected in series or in parallel by connecting passages for inflation.

Optionally, the foldable precursor includes un-inflated hinges on which the package is folded. Optionally the hinges are defined by marginal bond lines. Optionally, the hinges are formed by bonded areas.

Optionally, foldable package precursors and packages as described herein are configured so that the panels are self-folding after inflation, i.e., that bend at least partially to the final desired shape without having to be folded as a result of stresses in the package.

Optionally, a foldable package as described herein can have 2, 4, 5, 6, 7 or more separate foldable panels.

Optionally, according to some embodiments, each inflation port is connected to more than one, but not all the panels. Optionally, according to some embodiments, panel areas that are not directly connected to an inflation port are connected in series to an upstream panel area by a connecting passage. Optionally, according to some embodiments, at least some of the panels that are not directly connected to an inflation port are connected in parallel to an upstream panel by a connecting passage.

Optionally, according to some embodiments, the connecting passages are inwardly tapered i.e., progressively become narrower from respective upstream ends toward their downstream ends. This can help assure complete inflation of downstream panels.

Some embodiments of the invention pertain to foldable package precursors as described herein that are symmetrical about transverse or longitudinal fold lines, and to packages formed of such precursors. Some symmetrical embodiments are formed with transversely extending inflatable areas. Some symmetrical embodiments are formed with longitudinally extending inflatable areas, optionally, also including transversely extending inflatable areas, for example, at the tops and bottoms. The latter may in some cases, be better able to resist transverse and longitudinal bending forces. Optionally, the lines of symmetry are defined by non-inflatable hinge areas.

According to some symmetrical embodiments, packages are assembled by folding on the lines of symmetry, and bonding the contacting side edges parallel to the lines of symmetry together.

Optionally, the ends that are perpendicular to the lines of symmetry are left open to form the package as a sleeve. Optionally, the contacting edges at one of the perpendicular ends are bonded together to form a bag.

In the symmetrical bags just described, the top ends may be formed with flaps that are sealed to provide an air-tight enclosure to protect the packaged article from exposure to the environment.

Optionally, and alternatively, the open ends of such bags are formed of end panels that are sized and configured differently from the other panels so that the packages self-close, but do not seal, the open ends. Optionally, the end panels may be configured the same as the other panels so they are not self-closing. Optionally, non self-closing embodiments may include closures formed, for example, of hook and eye elements. Optionally the bottoms of bags may be closed by bonded hinges to provide partial closures.

Optionally, bags as described above can include handles at the top defined by un-inflated and surrounding inflated areas. Optionally, the un-bonded areas are removed, or left intact.

Some embodiments of the invention pertain to packages in which the article-receiving areas are recessed nest areas (sometimes referred to herein as "article-receiving areas"), optionally shaped to match the shape of at least a portion of an article to be received therein. Optionally, the nest areas include bottom surfaces within the margins of surrounding inflated areas, but no top surfaces. Optionally, film in areas within the nest areas is removed so that the nest areas have no top or bottom surfaces within the article-receiving areas. Optionally, only a portion of the bottom surfaces are removed, for example, to accommodate projecting portions of the packaged article.

Optionally, the un-inflated portions of article-receiving areas include top and bottom surfaces within the margins of surrounding inflated areas. Optionally, articles to be packaged are inserted into the article-receiving areas between the top and bottom surfaces through openings in the surrounding inflated areas. Optionally, the packaged articles are inserted into the article-receiving areas before the packages are inflated. Optionally, the packaged articles are not inserted into the article-receiving areas until after the package has been inflated.

Some embodiments of the invention pertain to inflatable package precursors and packages as described herein that have inflatable areas (or inflated areas) to provide cushions under the packaged article instead of recessed nests.

Some embodiments of the invention pertain to package precursors and inflated packages as described herein and multiple panels that are inflated by a single inflation manifold and a single inflation port. Optionally, more than one of the inflation ports, (but not all of them) are connected to separate inflation manifolds. Optionally the inflation ports are connected to a single inflation manifold.

Optionally, according to some embodiments, the precursor is formed on multi-layered polymer film sheeting having two or more separate sheets of polymer material bonded together in selected areas to define margins of inflatable and un-inflatable areas and inflation paths. Optionally, the two sheets are formed by longitudinally folding a single polymer sheet. Optionally, an extruded tubular sleeve can be employed. These alternatives will sometimes be referred to collectively below as "polymer sheeting" or simply "sheeting".

In some embodiments, the polymer film sheeting is formed by a sheet or sheets or an extruded sleeve of laminated layers of polyethylene and polyamide. However, laminated or un-laminated sheeting formed of other suitable polymer materials may also be used. Optionally, the thickness of the layers of the sheeting, or the thickness of the extruded sleeves is in the range of about 25 to about 400 microns.

Optionally, the polymers comprised in the sheeting may include additives, for example, to provide anti-static properties for packaging electronic equipment or anti-corrosive properties for packaging articles which require such protection or preservative for shipping perishable foods.

Some embodiments of the invention pertain to packages as described herein in which one or more of the panels comprised in the package are sealed from the others to form two or more separate compartments. This can provide backup or redundancy so that packaged articles remain protected in the event that part of the package is damaged and deflated.

Some embodiments of the invention pertain to package precursors as described herein, in which portions of the polymer sheeting are not bonded together, but are only bonded along marginal lines. Optionally, such portions are bonded together over their entire areas.

Optionally, according to some embodiments, bonding of the polymer sheeting is performed by welding using pressure and heat. Optionally, the bonding is performed by use of an adhesive, or in any other suitable and desired way.

Some embodiments of the invention pertain to package precursors and packages that have bonded shaping areas within the inflatable areas to help maintain the shape of the inflated package, for example, to prevent the inflated panels from ballooning. Optionally, the shaping areas are formed by spot or strip welding. Optionally, the entire areas within the margins of the shaping areas are bonded together. Optionally, the film within the shaping areas is removed.

Some embodiments of the invention pertain to package precursors and packages as described herein having a plurality of article-receiving areas arrayed longitudinally in one or more columns on the polymer sheeting, and which have separate inflation manifolds for inflation of adjacent package sites and/or portions of each package site.

Some embodiments of the invention pertain to package precursors having multiple package sites that are arrayed longitudinally in two or more rows on the polymer sheeting. Optionally, according to some embodiments, the package sites include two or more nest areas having different contours.

Some embodiments pertain to package precursors formed in strips, in which successive precursors on the strip are differently configured, for example, alternating top and bottom panels that are cut apart and placed above and below a packaged article in an outer container. Optionally, the precursors are stored on rolls having any desired number (for example, 25, 50, 100, 500 or intermediate numbers of precursors, or more or fewer) of the same or different configurations.

Some embodiments pertain to package precursors that are configured to receive one or more articles and to completely fill an outer container.

Some embodiments of the invention pertain to package precursors in which multiple inflation ports are provided within the margins of the inflatable areas that are formed of a two-surfaced inlet area, and a connecting passage between the inlet area and the inflatable area. Such precursors are optionally inflated by inserting a needle into the inlet area that pierces one surface or enters through a pre-formed opening. Optionally, the connecting passage is sealed after use, thus eliminating the need to otherwise seal the inflation port. Optionally, multiple needles are used to inflate different areas at the same time.

Some embodiments of the invention pertain to needle-inflated package precursors having multiple article-receiving areas formed in an array, for example, a 10×20, or larger or smaller array. Optionally, the articles are placed in recesses formed by un-inflatable areas before or after inflation. Optionally, the un-inflatable areas are configured as pockets within which the articles are placed before inflation. Optionally, in such embodiments, the inflation needles are inserted directly into the inflatable areas, which are sealed after inflation by spot welding, an internal one-way valve, or by an adhesive sticker placed over the needle insertion point.

Optionally, the article-receiving areas are separated by perforations, allowing individual areas, or rows and/or columns to be separated.

Embodiments employing needle inflation can sometimes be advantageous for some package configurations in that needle inflation and an inflation port inside the inflatable package can result in a saving in material. Use of an inflation port in the circumference of the inflatable areas of such configurations will require more material for the port itself and for a manifold. Also, for these configurations, the precursor may need to be larger, and a larger machine may be required to produce it.

Optionally, in the other embodiments described herein, more than one inflatable area can be inflated at the same time.

Optionally, in all the embodiments, different inflation pressures may be provided in different inflatable areas to accommodate the size and shape of particular articles to be packaged.

Some embodiments of the invention pertain to methods for forming inflated packages and package precursors from inflatable polymer sheeting. According to some embodiments, the methods include forming a plurality of inflatable and un-inflatable areas in the polymer sheeting that define package precursors having one or more of the features described above, releasably connecting inflation ports on the package precursors in succession or simultaneously to a source of inflation fluid through one or more inflation manifolds, and sealing the inflation ports after use. Optionally, at least one panel includes an article-receiving area.

In some embodiments, two or more inflation manifolds connect the inflation ports to the source of inflation fluid. Optionally, one or more inflatable areas are inflated through a single inflation port. Optionally, separate inflation ports are used to inflate each inflatable area. Optionally, the inflation ports are all connected to a single inflation manifold. Optionally, more than one, but not all the inflation ports are connected to different inflation manifolds.

Some embodiments of the invention pertain to methods as described herein in which the article-receiving areas are formed to create a first plurality of panels or cushions when the package is inflated. Optionally, according to some embodiments, a second plurality of inflation ports is formed to connect each inflation port to more than one, but not all the panels. Optionally, panels not connected to an inflation port are inflated through a connecting passage in series with an upstream panel area. Optionally, at least some of the panel areas not connected to an inflation port are inflated through a connecting passage connected in parallel with one or more upstream panel areas to an inflation manifold. Optionally, the connecting passages are not sealed after inflation of the package.

Optionally, according to some embodiments, remnants of the inflation manifolds remain on the package after inflation.

Optionally, according to some embodiments, perforations are formed on the inflatable polymer sheeting; and the inflated package is separated from scrap material along the perforations. Optionally, scrap material is removed before, during, or after inflation.

Optionally, according to some embodiments, features of the package precursors are formed by bond lines defining the margins of inflatable and non-inflatable areas. Optionally, the film within the margins of non-inflatable areas is bonded. Optionally, the film within the margins of non-inflatable areas is not bonded.

Optionally, non-inflatable areas within the inflatable panels define shaping areas to help maintain the desired shape of the inflated areas, for example, to prevent ballooning.

Some embodiments of the invention pertain to methods for forming foldable packages having at least one of the optional features described herein. Optionally, the method further includes bonding selected areas of the film or margins of such selected areas to form hinges between at least some of the panels to facilitate folding. Optionally, the methods include forming such foldable package precursors with no nest areas. Optionally, such foldable packages are formed to include nests.

Some embodiments of the invention pertain to methods for forming package precursors and foldable packages having at least one of the features described herein in which the inflatable areas and hinge areas of the precursors are positioned and configured so that the inflated packages tend to be self-folding.

Some embodiments of the invention pertain to methods for forming bags having at least one of the optional features described herein. Optionally, the method includes sealing the open ends of such bags to provide an air-tight enclosure to protect the packaged article from exposure to the environment. Optionally, the method includes forming such bags of panels that are sized and configured to close, but not to seal, the open end. Optionally, fasteners such as hook and eye element can be provided to close the open ends. Optionally, handles can be provided at the tops of the bags.

Some embodiments of the invention pertain to methods that include custom-designing the package precursors to accommodate any desired article configuration and packaging requirement. According to some embodiments, the method includes automatically inflating a succession of such custom-designed package precursors.

Some embodiments of the invention pertain to methods for forming package precursors and packages in which individual panels are directly inflated without inflation manifolds. In some embodiments of such methods, the precursors are formed by inflatable areas surrounding un-inflatable areas, and inflation ports located within the un-inflatable areas. Optionally the inflation ports include an inlet area and a connecting passage between the inlet area and the inflatable area. Optionally, inflation is accomplished using an inflating needle similar to ones used to inflating balls that pierce the inlet areas, or pass through a pre-formed slit or other opening in the inlet area.

Optionally, several inflating needles can simultaneously be used to inflate different panel areas. This can be advantageous since it can increase production speed and facilitates inflating panels to different pressures. In such directly inflated panels, the connecting passages are sealed after inflation.

Optionally, the inflation ports in these and in all the other embodiments described herein are sealed by heat/pressure welding, by an adhesive or by internal one-way valves, for example, formed by flaps. Optionally, the openings in some of the needle-inflated embodiments can be self-sealing by using a thixotropic puncture-preventative fluid such as Tyre Protect™ available from Puncture Safe, Salford, Lanc's UK, or a glycol-base product such as that available from Viking Seal™, North Tonawanda, N.Y. U.S. or other suitable and desired material as the inflation fluid.

Some embodiments of the invention pertain to methods for forming inflated packages that are inflated by compressed air. Optionally, gasses other than compressed air and foam forming fluids as described above can be used.

Some embodiments of the invention pertain to precursors for inflatable packages formed by an array of article-receiving panel areas, that are defined by inflatable areas surrounding un-inflatable areas, and having an inflation point configured to accommodate entry of an inflation needle, and perforations surrounding each article receiving area that allow the article-receiving areas to be separated from each other and surrounding scrap material, and to packages formed by inflation of such a precursor.

Optionally, the un-inflatable areas are separated from the inflatable areas by bond lines.

Optionally, in some embodiments, the inflation points are sealed after use by spot welding, or by an internal one-way valve, or by an adhesive sticker placed over a needle-receiving opening. Optionally, the openings in the needle-inflated embodiments can be self-sealing by using a thixotropic puncture-preventative fluid or a glycol-base product.

Optionally, the un-inflated areas form recesses configured to receive the packaged article, or are configured as pockets for receiving the packaged articles.

Optionally, the un-inflated areas within the article-receiving areas include further inflatable areas, and separate inflation points for each inflatable area configured to accommodate entry of an inflation needle.

Some embodiments of the invention pertain to precursors for inflatable packages having a plurality of inflatable panel areas configured to be folded around, and to at least partially cover the bottom, top, sides, and one end of a packaged article, a further inflatable panel area configured to be folded to cover the other end of the packaged article, and an un-inflatable flap configured to overlie the further inflatable panel to protect the further inflatable panel from damage by a sharp projection of a packaged article, and to a package formed by inflation of the precursor.

Optionally, tabs projecting from the flap and from the further panel area are sealed to each other to secure the flap and the further panel area together.

Optionally, the plurality of panel areas and the further panel area are comprised in two separate compartments.

Optionally, in some embodiments, a single inflation port is provided for inflating both compartments.

Optionally, the single inflation port is defined by an inlet, and branches that form inflation paths for the two compartments.

Optionally, the two branches of the inflation port are sealed by a single welded bond on a package formed by inflation of the precursor.

Optionally, in some embodiments, there are connecting passages between the plurality of panel areas.

Before considering the description of various embodiments of the invention in detail, it should be noted that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

It is also emphasized that the various options and alternatives described herein in the context of a particular embodiment are applicable to all embodiments, unless specifically stated otherwise.

To recap, features of the precursors and inflated packages may include, but are not limited to one or more of the following:

a) the packages may be formed from precursors having inflatable and non-inflatable areas that are inflated by one or more inflation ports connected in series or in parallel to one or more of the panels, and to a source of inflation fluid through one or more inflation manifolds;

b) the packages may be formed from precursors that include multiple inflatable areas that form panels that can be folded and at least partially wrapped around the packaged articles, and in which fold lines are defined by hinges formed by un-inflated areas defined by bond lines or bonded areas;

c) the panels can be inflated by a single inflation port through a single inflation manifold, or by two or more inflation ports connected to separate inflation manifolds, or more than one inflation port, but not all the inflation ports can be connected to one of several inflation ports;

d) foldable package precursors and packages can be configured so that the panels tend to be self-folding after inflation;

e) the connecting passages can be tapered inwardly from their upstream to their downstream ends to help assure complete inflation of the downstream panels;

f) the panels are typically inflated by compressed air, or by other possible inflation fluids including nitrogen, $CO_2$, argon, SF6, propane, butane, freons, and hydro fluoro carbons (HFC), or by a combination of foam-forming fluids, for example, a monomer with at least two isocyanate functional groups with another monomer with at least two hydroxyl or alcohol groups that react in the presence of a catalyst to form polyurethane foam;

g) some panels can be inflated with foam and others by compressed air or other gas, to by a combination of gasses;

h) the package precursors can include registration marks to help position the precursors in an inflator;

i) at the upstream ends of sheets or rolls of package precursors, the inflation manifolds can extend longitudinally beyond the boundaries of the precursor to assist insertion of an inflation nozzle that is part of an inflator, and which ends are removed from the inflated package;

j) package precursors can include panel areas symmetrically arranged about a transverse or a longitudinal fold line that can extend transversely or longitudinally and can also include transversely extending inflatable areas at the tops and bottoms.

k) the lines of symmetry can be defined by non-inflatable hinge areas comprised of spaced bonded marginal lines or bonded areas;

l) the symmetrical packages can be assembled by folding the precursors on the lines of symmetry, and bonding the opposed side and bottom edges together to form a bag, or the ends can be left un-bonded to form a sleeve, or can include a short hinge formed by downwardly depending un-inflated tabs that are bonded together;

m) the open ends of the bags can include flaps that are sealable to provide an air-tight enclosure to protect the packaged article from exposure to the environment or can be formed of panels that are sized and configured differently from the other panels so that the packages self-close, but do not seal, the open ends;

n) closures, for example, Velcro® hook and eye strips, may be attached to the open ends that permit closure of the bags as a whole;

o) the precursors can be formed from polymer sheeting in which two or more separate layers of polymer material are bonded together in selected areas to define the margins of inflatable and un-inflatable areas, or by a longitudinally folded single polymer sheet or by an extruded sleeve;

p) the sheeting may be formed of alternating layers of polyethylene and polyamide, or of layered or un-layered sheets of other suitable polymer materials, for example, in the range of about 25 to about 400 microns in thickness;

q) the article-receiving areas may have bottom surfaces, but no top surfaces, or both top and bottom surfaces, or the film in the article-receiving areas can be removed so that the article-receiving areas have neither top nor bottom surfaces, or only a portion of the bottom surfaces can be removed, for example, to accommodate projecting portions of the packaged article;

r) the package precursors may have a plurality of article-receiving areas arrayed longitudinally in one or more columns on the polymer sheeting, and may have separate inflation manifolds for inflation of adjacent package sites and/or portions of each package site;

s) the package precursors and packages may include two or more adjacent article-receiving areas having different contours, or may be in the form of rolls in which adjacent precursors are different, for example, alternating panels configured as top and bottom panels that are cut apart and placed over and under an article;

t) rolls of precursors may include any desired number of precursors, for example, 25, 50, 100, 500 or an intermediate number, or more or fewer, of the same or different configurations;

u) inflated packages may be configured to receive one or more articles;

v) inflated packages may be shaped and sized so that a single package completely fills an outer container;

w) package precursors may be transformed into finished packages manually, for example, by inflating, sealing, cutting, trimming, etc., or by high-speed automatic production line including an inflator and other processing stations;

x) package precursors may have inflation ports formed by un-bonded areas located within an inflatable area that are connected to the rest of the inflatable area, and are configured to be inflated manually or by machine through a needle that enters through a pre-formed opening in the top of the inflation port, or which punctures the top of the inflation port;

y) the inflated areas on the one face of the package may be larger than those on the oppose face, whereby the inflated areas extend outwardly from a plane of the package further on the one side;

z) the inflated areas on the one face may be staggered transversely or longitudinally relative to those on the opposite face so that the inflated areas of the packages interleave when placed in an outer container;

aa) in some needle-inflated precursors, the portions of the inflation ports that are connected to the rest of the inflatable area may be sealed so that the area through which the needle enters does not need to be sealed;

bb) in needle-inflated precursors, the precursor may be in the form of an array of article-receiving panel areas that are defined by inflatable areas surrounding un-inflatable areas;

cc) the arrays may include perforations surrounding each article receiving area that allow the article-receiving areas to be separated from each other and from surrounding scrap material;

dd) the inflation points may be sealed after use by spot welding, or by an internal one-way valve, or by an adhesive sticker placed over a needle-receiving opening. In some embodiments, the inflation point may be sealed by a water-base or glycol base inflation fluid such as employed to seal tire punctures;

ee) the un-inflated area may be configured as a recess configured to receive the packaged article, or as a pocket for receiving the packaged article;

ff) the un-inflated areas of the article-receiving areas may include further inflatable areas and separate inflation points for each inflatable area;

gg) the precursor may be formed by a plurality of inflatable panel areas configured to be folded around, and to at least partially cover the bottom, top, sides, and one end of a packaged article, a further inflatable panel area configured to be folded to cover the other end of the packaged article, and a flap configured to overlie the further inflatable area;

hh) tabs projecting from the flap and from the further panel area may be sealed to each other to secure the flap and the further panel area together;

ii) the plurality of panel areas and the further panel area may be comprised in two separate compartments;

jj) a single inflation port may be provided for inflating both compartments;

kk) the single inflation port may be formed by an inlet, and branches that form inflation paths for the two compartments;

ll) the two branches of the inflation port may be sealed by a single welded bond on a package formed by inflation of the precursor.

Packages designed according to embodiments of the invention have extraordinary versatility, allowing custom-design for a wide range of packaging applications, for example, including, but not limited to:

a) packages may have simple configurations, for example with one or more article-receiving areas in the form of regular polygons or circles for storage of articles in layers in an outer container;

b) the packages may be of highly complex and sophisticated configurations to accommodate irregularly shaped article or formed of different parts designed as top and bottom covers for a packaged article;

c) the packages may be formed of foldable panels that at least partially surround a packaged article;

d) the packages may be configured with two, three, or four inflated panels having openings within the inflated areas and which can to be folded around and to protect only the corners of packaged articles;

e) packages can be configured so that one fills an entire outer container, or can even serve as an outer container;

f) the packages can be configured to be folded to form sealable bags, thereby isolating a packaged article from the environment, or the bags can be self-closing to assure retention of a packaged article;

g) the packages can be inflated by compressed air or other suitable inflation fluids, including foam-forming fluids, or different parts may be inflated by different inflation fluids;

h) the inflation fluid may be frozen to protect perishable foods or other articles;

i) the packages may be designed to prevent projections of a packaged article from damaging the inflated parts of the package by configuring the package so that projections are in contact with an un-inflated area in the package, or by configuring the packages to include one or more un-inflated areas forming chambers to receive projections of a packaged article;

j) packages may be formed of arrays of article-receiving areas that are separable from each other by perforations;

k) foldable packages may be configured to have an inflated panel covered by an un-inflated flap to protect the panel from damage due to sharp projections on a packaged article.

Details concerning the foregoing and other embodiments are presented below, and will be understood by persons skilled in the art from the description herein.

A Basic Precursor Example

With reference now to FIGS. 1-3, there is illustrated an exemplary embodiment of a package precursor from which general concepts will be explained. As shown, a package precursor 20, is formed from polymer film sheeting 21, which may be comprised of two or more layers of polymer film bonded together to define margins of inflatable and non-inflatable areas and areas that will be connected to a source of inflation fluid. Alternatively, sheeting 21 may be formed of one or more folded layers bonded at the required locations, or from an extruded sleeve.

Typically, the polymer sheets or sleeves are formed of a laminate comprised of alternating layers of polyethylene and polyamide. Sheeting having a thickness in the range of about 25 to about 400 microns is suitable. Such sheets and sleeves are available commercially from numerous sources, typically having up to nine laminated layers. Other laminated and non-laminated polymer sheeting or sleeves having sufficient strength and flexibility for inflation, sufficient non-permeability to maintain inflation, and which are suitably inert for a particular packaging application may also be used.

Optionally, the polymer sheeting or extruded sleeves may include additives to meet particular packaging needs. For example, additives may be used that provide anti-static properties for packaging electronic equipment or that provide anti-corrosive properties for packaging articles which require such protection, As another alternative, additives my provide a preservative for shipping perishable foods.

A Basic Package Precursor, Package and Method

FIG. 1 shows a package precursor 20 comprised of three article-receiving areas 22, 24, and 26 shown here as recessed nest areas in which packaged articles are received. It should be understood, however, that in general, there can be any desired number of longitudinally arrayed article-receiving areas in one or more rows.

Package precursor 20 may be cut to a desired length between two article-receiving sites for flat storage, as illustrated in FIG. 1, or stored as a roll before inflation as discussed in connection with FIGS. 2A and 8.

Each of article-receiving areas 22, 24, and 26 is comprised of a central non-inflatable area 28*a*-28*c* forming the nest for a packaged article. The nest areas are surrounded by inflatable areas 32*a*-32*c*. The inner margins of inflatable areas 32*a*-32*c* are formed by bond lines 36*a*-36*c*. These also form the outer margins of non-inflated areas 28*a*-28*c*. The outer margins of inflated areas 32*a*-32*c* are formed by bond lines 34*a*-34*c* defining an additional non-inflatable area 38 that surrounds the article-receiving areas. Formation of the bond lines is described below.

It should also be appreciated that non-inflatable areas 28*a*-28*c* and 38 can optionally bonded over their entire respective areas, if desired.

Package precursor 20 also includes two inflation manifolds 40*a* and 40*b* extending longitudinally near the edges 42*a* and 42*b*. The margins of inflation manifolds 40*a* and 40*b* are formed by bond lines 43*a* and 43*b* of non-inflatable area 38 At the leading edges 44*a* and 44*b* of sheet 20, inflation manifolds 40*a* and 40*b* at open to permit connection to a source of compressed air or other inflation fluid as described below. According to some embodiments, suitable inflation pressure is in the range of about 0.15 to about 0.35 kg/square cm, for example, about 0.3 kg/square cm. depending on the size and shape of an article to be packaged. For example, greater pressures can provide greater resilience and/or more protection.

As will be understood by those skilled in the art, with some inflation fluids, the internal pressure of the inflated areas may drop if packages are exposed to a very low temperature environment, or may rise if packages are exposed to a very high temperature environment. Under such conditions, pressures at the upper or lower ends of the range, or even higher or lower pressures may be desirable.

In the illustrated embodiment, inflation manifolds 40*a* and 40*b* provide inflation fluid to alternate article-receiving sites. Thus, inflation manifold 40*a* serves article-receiving sites 22 and 26, and inflation manifold 40*b* serves article-receiving site 24.

The inflatable areas of article-receiving sites 22, 24, and 26 are connected to their respective inflation manifolds by inflation ports: ports 46*a* and 46*c* connect inflatable areas 32*a* and 32*c* to inflation manifold 40*a*, and port 46*b* connects inflatable area 30*b* to inflation manifold 40*b*. These are defined by bond lines as now described.

Bonding of the desired marginal areas of sheeting 21 is advantageously accomplished by welding by application of heat and pressure. Techniques for such bonding of polymer films are known to those skilled in the art, and any of these, or other suitable techniques may be used. Bonding can also be performed by use of any desired adhesive suitable for use with the polyethylene-polyamide sheets, or in any other suitable and desired way.

To provide a finished appearance for the inflated package, it is desirable to be separate the inflated package from the surrounding scrap material by perforations shown by dotted lines 50 in FIG. 1. As will be appreciated, in the embodiments of FIG. 1, area 38, and the areas between article-receiving areas 22, 24, and 26 are scrap material that will be discarded after separation. For packages that are inflated by two opposing inflation manifolds as illustrated in FIGS. 1 and 2, the tension created during inflation tears off the inflated package along perforation line 80. If the package remains attached to the scrap at a few points, it can readily be pulled off manually. If the configuration of the package does not permit complete separation from the scrap material, it too may be removed manually, or a cutting die may be employed.

As in the case of other features described herein, perforations or machine-removal of scrap material may advantageously be employed in any of the embodiments of the invention.

Nest areas 28*a*-28*c* may be configured in various ways. By way of example, typically, margins 34*a*-34*c*, and 36*a*-36*c* are only bonded along the marginal lines themselves, thereby forming the outer margins of article-receiving areas 28*a*-28*c*, and inner margins of non-inflatable region 38, respectively. In some embodiments, instead of bonding just the margins, the polymer sheets may be bonded over the entire areas 28*a*-28*c* to form a bottom surface on which the packaged article will be placed. Alternatively, the areas within margins 36*a*-36*c* are removed leaving empty spaces as the article-receiving areas 28*a*-28*c*. Optionally, only parts of article-receiving areas may be removed, for example, to accommodate projecting portions of the packaged article. The material within margins 36*a*-36*c* is removed, for example, by means of perforations, or by die cutting as described above.

As a further alternative, in some embodiments, margins 36*a*-36*c* are bonded, but the sheets within areas 28*a*-28*c* are left un-bonded. Inflation passages (not shown) are provided to these un-bonded spaces to allow inflation, thereby forming cushions on which the packaged articles will be placed instead of recessed nests. If desired, these areas may be inflated to a lesser pressure within the indicated range than in the areas formed by surrounding areas 32*a*-32*c*.

As a further un-illustrated alternative, in some embodiments, margins 36*a*-36*c* are bonded, but the material within margins 36*a*-36*c* is left un-bonded, and inflation passages are not provided. Instead, one side of margins 36*a*-36*c* is left open, and bond lines 54*a*-54*f* are provided. This creates pockets between the top and bottom surfaces in which packaged articles are placed in the inflated package. Alternatively, the articles can be inserted before or after the package precursors are inflated.

Figure 2A:
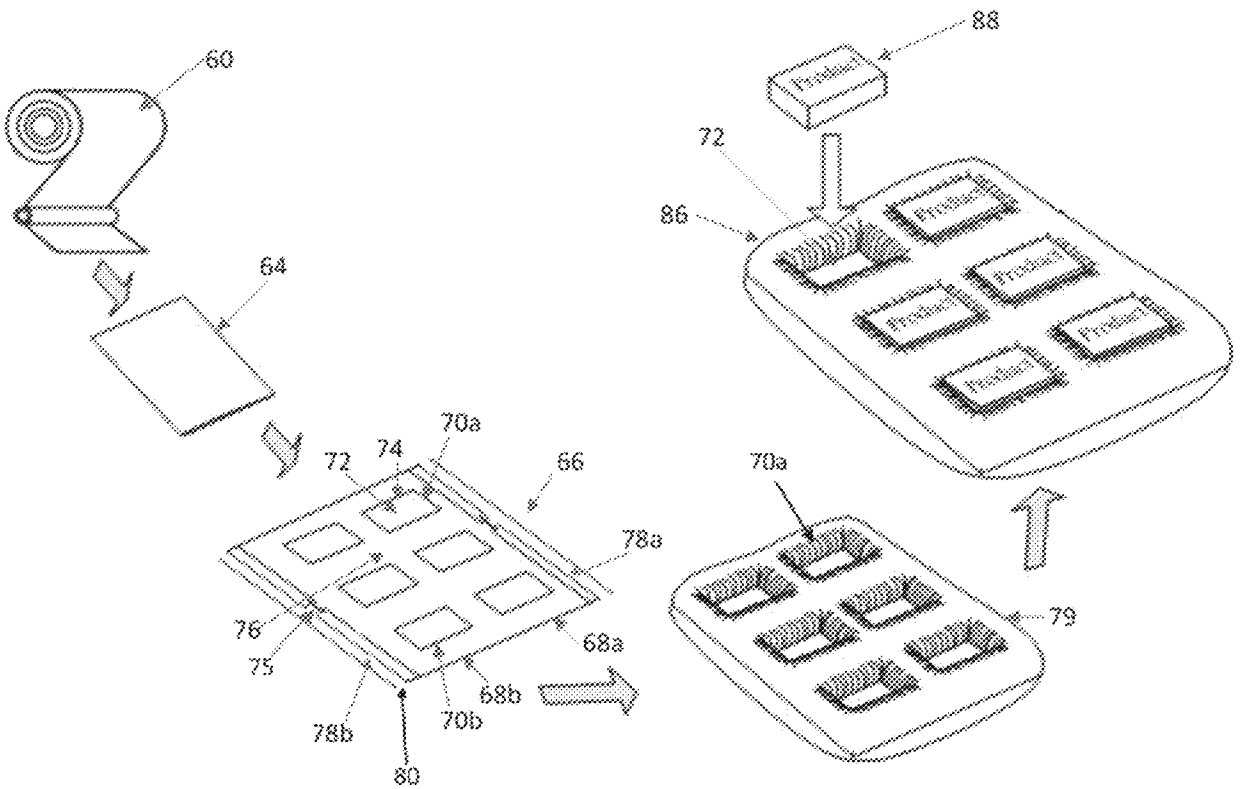
FIG. 2A is a schematic perspective showing the formation of a package precursor, inflation and use of a package according to some embodiments of the invention.

FIG. 2A illustrates schematically a method of creating an inflated package according to some embodiments of the invention. The method begins with a roll of polymer sheeting 60 comprised of two or more sheets, or alternatively, of a single longitudinally folded sheet or an extruded sleeve 60. Sheeting roll 60 may be cut into sheets 64 for flat storage, or optionally, maintained in roll form.

A package precursor (enlarged relative to sheet 64 for clarity) is then formed by bonding at the locations required to create the desired features as described above in connection with FIG. 1. The precursor sheets 66 may be stored flat before inflation. Alternatively, the precursors may be stored as a roll, which may have any desired number of precursors, for example, 25, 50, 100, 500 or more or less. The precursors shown in FIG. 2A are configured alike, but may optionally be of different configurations. As an example, alternating precursors on the roll may be configured as top and bottom panels that are cut apart and placed over and under an article, or may have different surface configurations on opposite faces, as described below.

Figure 2B:
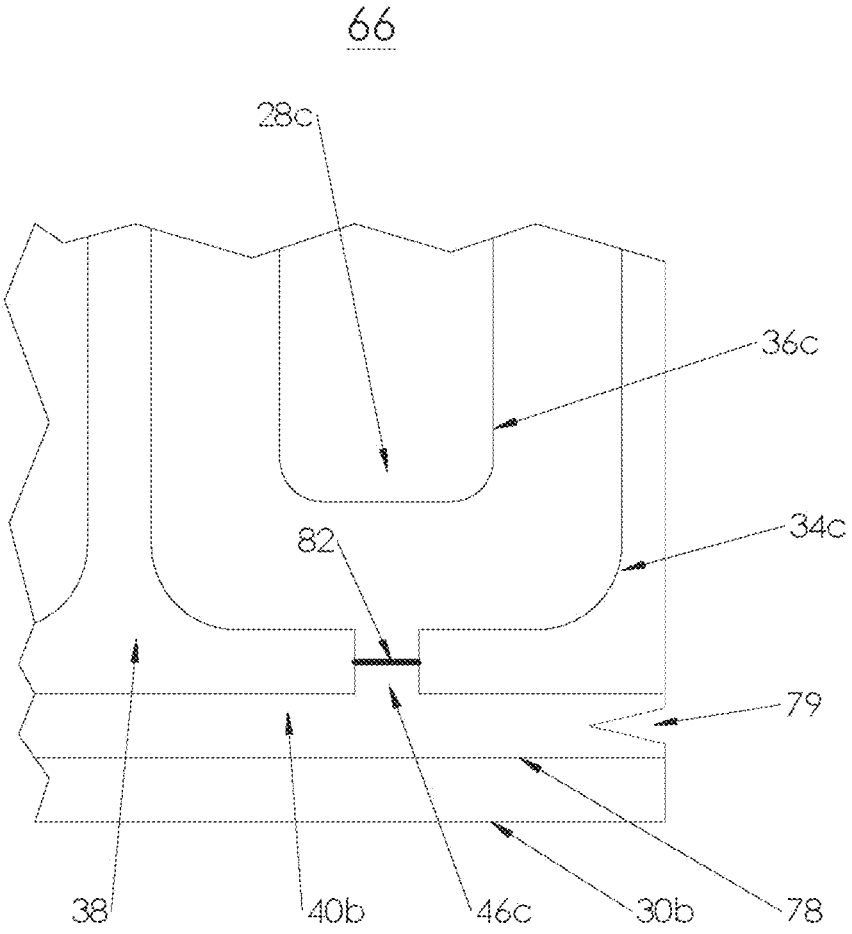
FIG. 2B is a fragmentary enlarged view of a package precursor showing an inflation guide.

FIG. 2B is an enlarged view of inflation manifold 40*b* showing an optional feature. Here, the upstream ends of the manifolds at the beginning of a sheet or roll are elongated as at 78 and optionally, may be partially slit as at 79. As will be appreciated, inflation manifold 40*a* is similarly constructed.

Elongation of the manifolds can be advantageous in that it may facilitate entry of inflation nozzles that are part of automated inflation machinery as described below. Optionally, the nozzle can be inserted manually into the elongated ends 78.

Figure 2C:
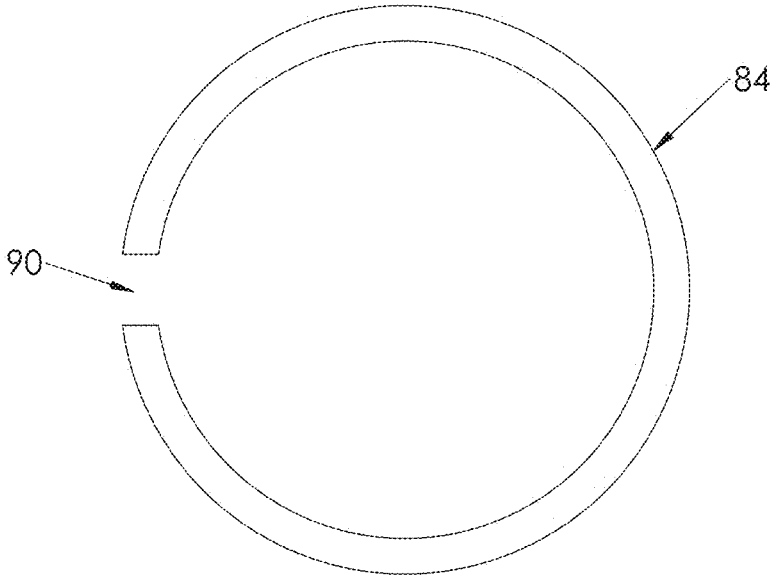
FIG. 2C is a schematic sectional view of an optional aspect of inflation of a package according to some embodiments of the invention.

Another feature of some embodiments is illustrated in FIG. 2C. To allow passage of the inflation nozzles through the inflation manifolds to each of the inflation ports in succession, after one of the inflatable areas has been inflated, and the associated inflation port has been sealed, the inflation manifolds are slit longitudinally as indicated at 90 in FIG. 2C. The slits may be made by cutters which are part of the inflation machine.

FIG. 2A also shows another optional feature, namely registration marks, one of which is shown at 75 to aid in positioning the precursor in an inflation machine.

Figure 3A:
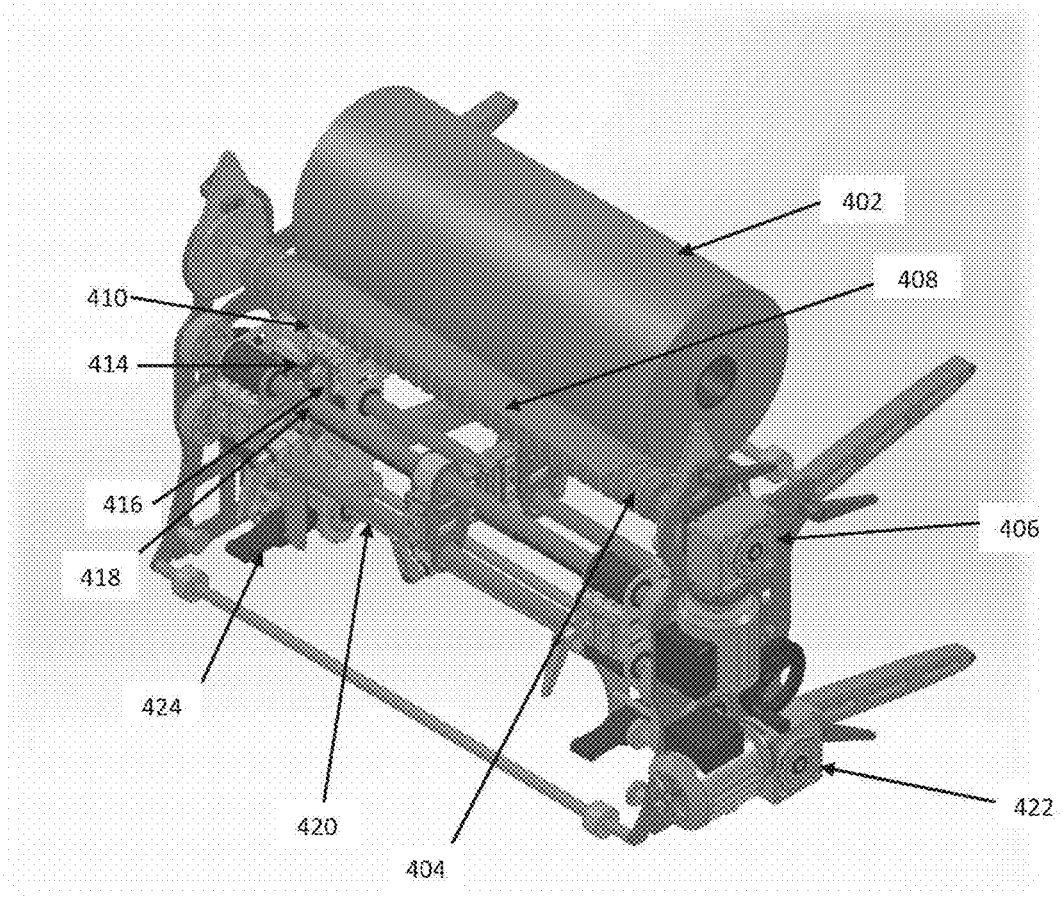
FIG. 3A is a perspective view of an exemplary inflator suitable for use to inflate package precursors according to some embodiments of the invention.
Figure 3B:
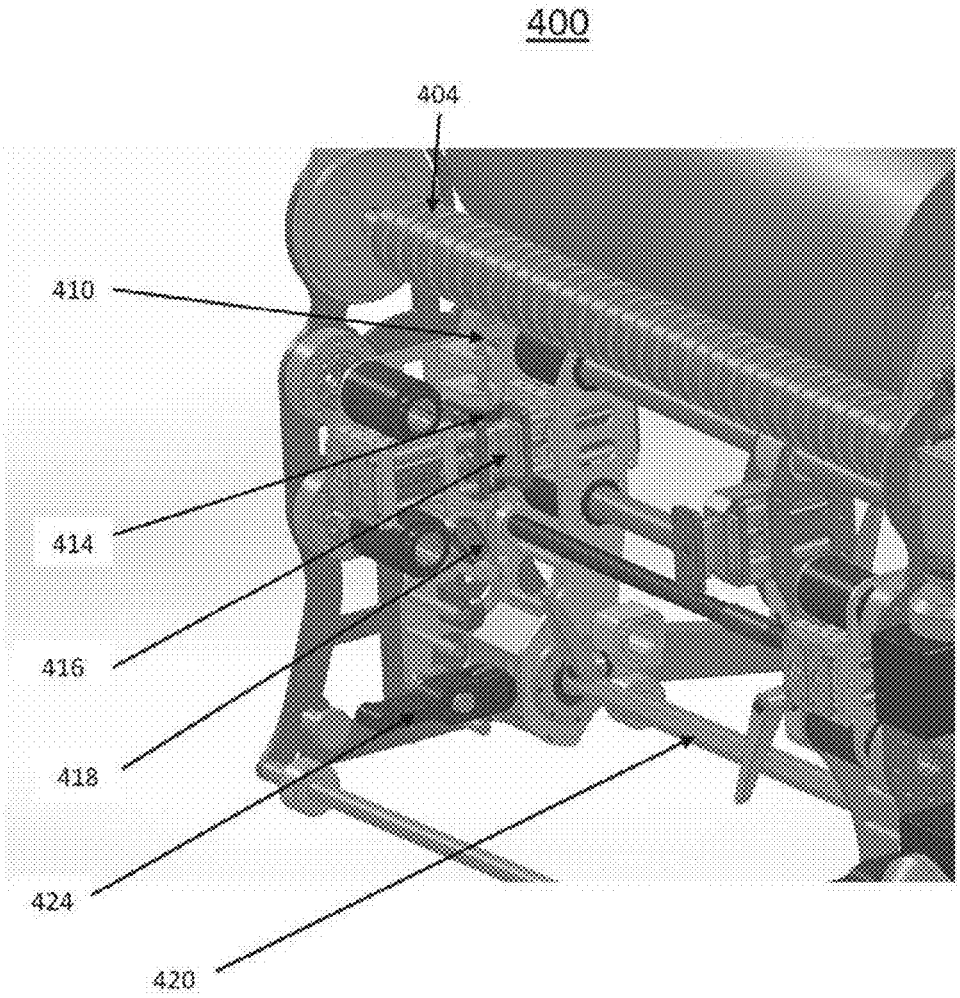
FIG. 3B is an enlarged view of a portion of FIG. 3A.
Figure 3C:
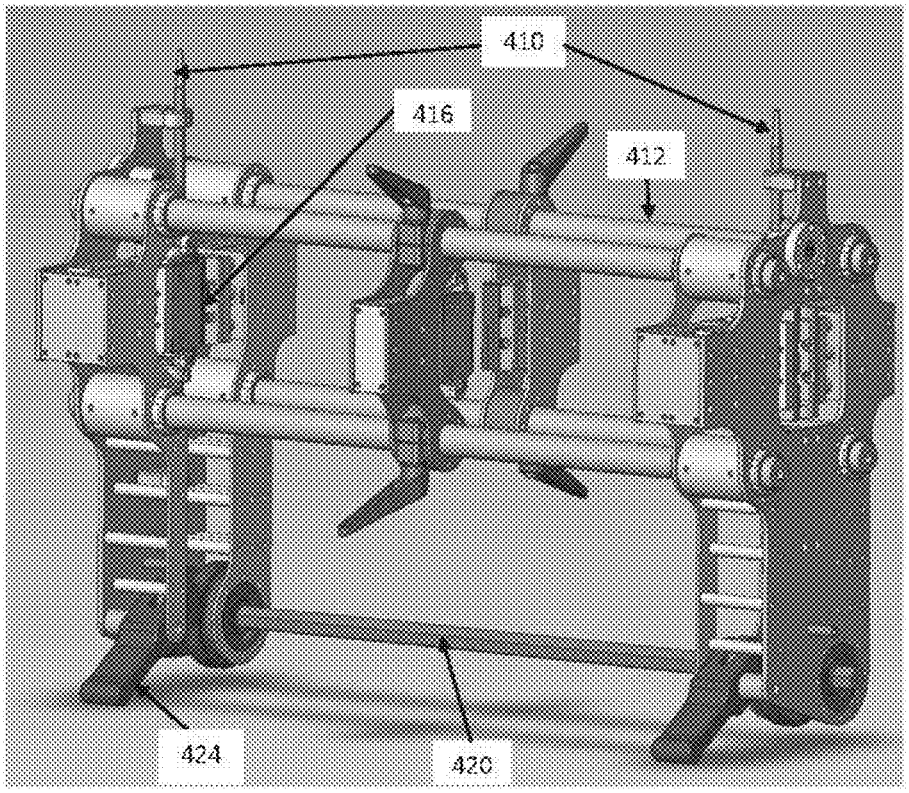
FIG. 3C is an enlarged perspective view of portions of FIGS. 3A and 3B with parts removed to better illustrate other parts.

Before proceeding further, attention is directed to the fact that various machines may be used to inflate the package precursors. As one non-limiting example, FIGS. 3A-3C illustrate an inflation machine 400 (referred to below as "inflator" designed for use in converting package precursors such as 66, 90, 128, 190, and 324, (shown in FIGS. 2, 4, 7, 9, 12, and 14, respectively into inflated packages. FIG. 3A is a perspective view of machine 400 seen from the downstream end. FIG. 3B is an enlarged perspective view of a portion of FIG. 3A. FIG. 3C is an enlarged perspective view of FIGS. 3A and 3B with certain parts removed to more clearly show other parts. It should be noted that certain parts of inflator 400 have been omitted in all of FIGS. 3A-3C as indicated below to avoid obscuring other features and other structural element have not been described in the interest of brevity.

It should also be noted that several components of inflator 400 are duplicated on both sides of the precursor roll. This is noted in the description, but in the interest of brevity, the duplicated components are also not separately described.

As illustrated, inflator 400 is designed to accommodate a precursor roll 402, and includes a roll feeder 404 driven by a motor 406. The leading edge 408 of roll 402 may be seen on top of roll feeder 404 in FIG. 3A.

Alternatively, inflator 400 may be constructed to accommodate precursor sheets rather than rolls, and will include a suitable sheet feeder (not shown) instead of roll feeder 404.

The exemplary package embodiments mentioned above are inflated through two longitudinally extending manifolds, and to provide for this, inflator 400 includes an inflation area comprised of two vertically extending inflation nozzles 410, one on each side of the machine. These are positionable on a shaft 412 to accommodate precursor rolls of different widths. (Nozzles 410 and shaft 412 are clearly visible in FIG. 3C.)

Other components of inflator 400 include manifold sealing devices 414, welding stations 416, manifold cutters 418, a pull shaft 420 driven by a pull motor 422 and associated holding blocks 424. Manifold sealing devices, welding stations, manifold cutters, and holding blocks are provided on both sides of inflator 400, and are advantageously adjustable transversely of precursor roll to accommodate different sized rolls.

The function of manifold sealing devices 414 is to clamp the manifold on its upstream and downstream sides around the inflation nozzles to provide a closed pocket thorough which inflation fluid is provided to an inflation port. As will be appreciated, the inflation fluid fills the pocket and passes through the inflation port to inflate an inflatable area of the precursor. As will further be understood, in those precursor and package embodiments having more than one inflatable areas served by an inflation port, the inflation fluid passes from the inflatable area connected to the inflation port on through the connecting passages to the other inflatable areas.

The function of welding stations 416 is to provide a seal across an inflation port after the inflatable areas served by it have been inflated. To maintain inflation while the inflation port is being sealed, sealing devices 414 remain clamped around the inflation manifolds until after the inflation port has been sealed.

The function of manifold cutters 418 is to slit the used portion of the manifolds as described in connection with FIG. 2C so that the precursor can advance through the inflator to permit the inflatable areas of the precursor, or of precursors of successive packages to be inflated.

The inflated precursor is drawn through the inflator by engagement with pull shaft 420. This is rotatably driven by pull motor 422. Feed motor 406 and pull motor 422 are synchronized so both operate together and provide a constant force on the precursor as it travels through the inflator. Holding blocks 424 keep the precursor in contact with pull shaft as the precursor is inflated and advanced.

Briefly, operation of inflator 400 may be described as follows:

Prior to activating the inflator, inflation nozzles 410 are inserted into the leading edges of the two inflation manifolds on the precursor. In the illustrated embodiment, this is done manually, but in an un-illustrated embodiment, inflator 400 can be constructed to perform this operation automatically. The leading edge 408 of precursor roll 402 is then pulled down and attached to pull shaft 420 by means of holding blocks 424.

Drive motor 406 and pull motor 422 are then activated, and precursor roll 402 is advanced to the position for inflation of the first inflatable areas. The motors are synchronized as previously mentioned.

When the first inflation location is reached, which may be recognized by sensing a registration mark on the precursor, motors 406 and 422 stop rotating and movement of precursor 402 is halted. Sealing devices 414 block both upstream and downstream parts of the inflation manifolds around the inflation nozzles 410.

Inflation fluid is then provided through nozzles 408 into the inflation ports at the first inflation location, and the inflatable area or areas fed by the inflation ports are inflated.

Inflation continues until the pressure inside the inflated areas reach desired levels. As noted above, the same or different pressures may be provided to the two areas being inflated. The inflation pressure may be determined by pressure sensors (not shown).

Inflation then stops, and while the inflation manifolds remain sealed around the inflation nozzles, welding devices 416 apply a transverse weld across the inflation port.

As previously noted, the inflation process creates forces that separate the inflated precursor from the scrap material around it. The inflated package remains attached at the ends of the inflation ports to the inflation manifolds. The inflated package is finished by cutting the open ends of the inflation ports to separate the package from the inflation manifold. This cutting is done either by a cutter (not shown) which is part of inflator 400, or manually.

After inflation, motors 406 and 422 advance the precursor to the next inflation area. While the precursor advances, blades 418 cut a slit along each of the inflation manifolds to enable the precursor to advance.

Continuing now with respect to inflation of the precursors, compressed air is typically used as the inflation fluid. However, according to some embodiments, other inflation fluids may be used, for example, nitrogen, $CO_2$, argon, SF6, propane, butane, freons, or hydro fluoro carbons (HFC). Optionally, one or more parts of the package precursors may be inflated by a combination of foam-forming fluids, for example, a monomer with at least two isocyanate functional groups with another monomer with at least two hydroxyl or alcohol groups that react in the presence of a catalyst to form polyurethane foam. Another option is to use different inflation fluids in different parts of the precursor.

Use of gasses other than compressed air, for example, heavier gasses, may be desirable to minimize loss of inflation, or to provide an inert fluid where exposure of the packaged article to oxygen may be undesirable.

Use of foam may be desirable, for example to avoid the risk of deflation of one or more parts of the package due to damage.

Optionally, the inflation fluid in the package can be frozen after inflation, for example, for packaging frozen foods, or other articles which must be kept very cold.

In the embodiment illustrated in FIG. 2A, package precursor 66 is a variation of the package precursor 20 illustrated in FIG. 1. Here, there are two parallel columns of nest areas 68*a* and 68*b*, each comprised of three nest areas, two of which are indicated at 70*a* and 70*b*. The nest areas are comprised of un-inflatable and un-bonded bottom surfaces 72, with a surrounding inflated region 76 and a surrounding bonded area 74. Two separate inflation manifolds 78*a* and 78*b* are shown, either of which can be used for inflation of region 76.

A point to be noted in connection with FIG. 2A is that the pinched-off parts of the manifolds represent sealed connecting passages that represent inflation ports connecting the manifolds region 76. It should be appreciated that before inflation, the connecting passages are not sealed.

As a variation of the precursor illustrated in FIG. 2A, only one inflation manifold is provided. In a second un-illustrated variation, a longitudinal bond between the two parallel columns 68*a* and 68*b* is provided, whereby the two parts form separate inflatable compartments. These can be inflated by two manifolds each connected to a separate inflation port. In yet another un-illustrated variation, the nest areas can be separated from each other by bonds defining separate panels, and separate inflation ports are provided for each panel.

It should be appreciated that all of the variations of the nest areas, and other features described herein are also applicable to precursor 66.

The package after inflation is indicated at 79. Here, the inflation ports used to inflate areas 76 are sealed at 75, typically by transverse bonds, or by one-way valves, or by a suitable adhesive to maintain inflation of areas 76. It should be understood that the inflation ports 46*a*-46*c* in FIG. 1 and inflation ports in other embodiments described below may be similarly sealed.

In addition, to provide a finished appearance to package 79, the inflation manifolds that have been slit as described in connection with FIG. 2B may be trimmed to leave only a small remnant. It should again be understood that inflation manifolds in other embodiments described herein may be similarly slit and trimmed Referring still to FIG. 2A, finished package 86 is shown with articles already inserted in five of the six article-receiving areas 72. Also shown is a packaged article 88 about to be inserted in the sixth article-receiving area. The cut and trimmed inflation manifolds and scrap material and the branch passages are not shown.

An Exemplary Foldable Package and Precursor

Figure 4:
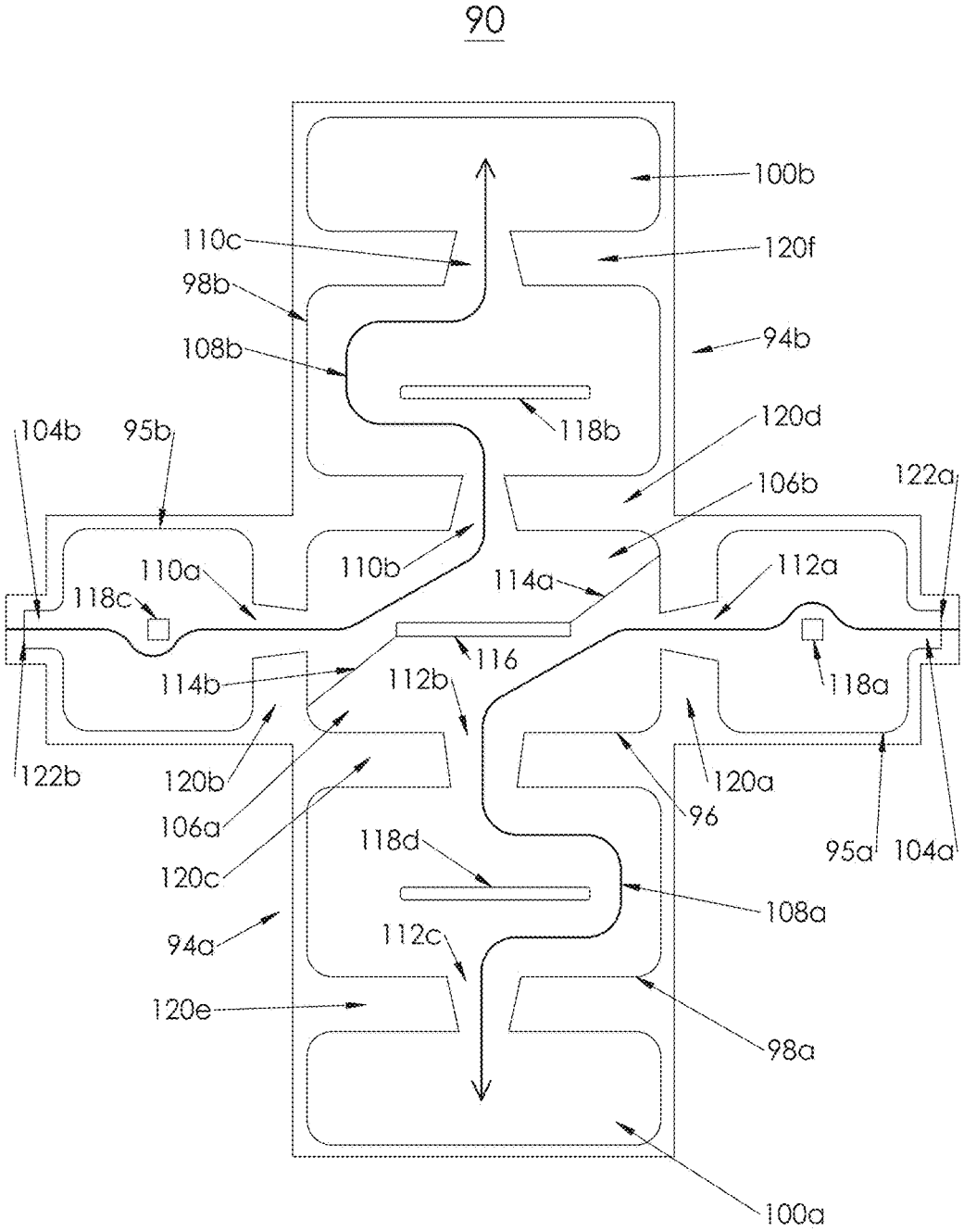
FIG. 4 is a plan view of a package precursor for a foldable package according to some embodiments of the invention.
Figure 5:
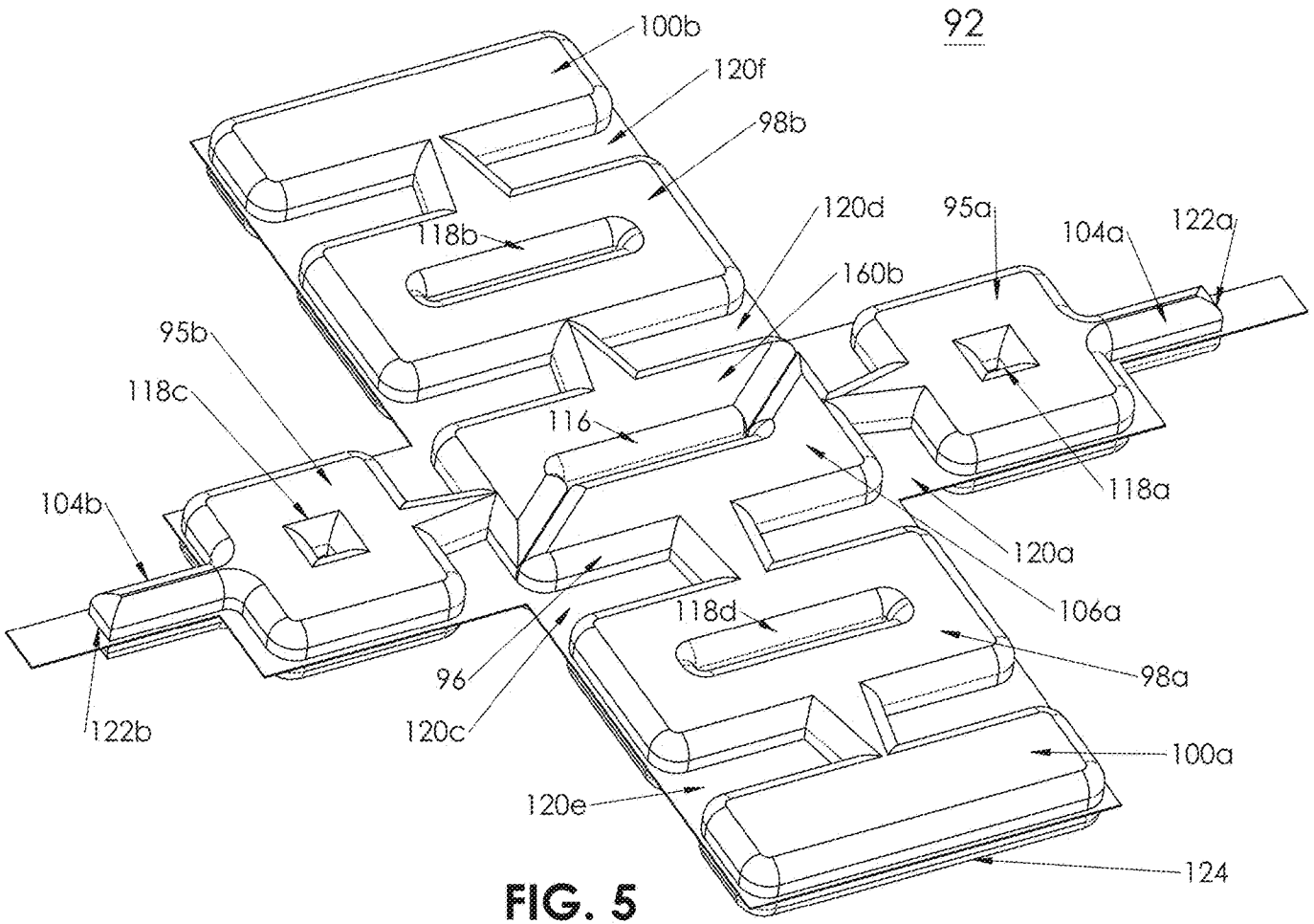
FIG. 5 is a perspective view of an inflated package formed from the package precursor as shown in FIG. 4.
Figure 6:
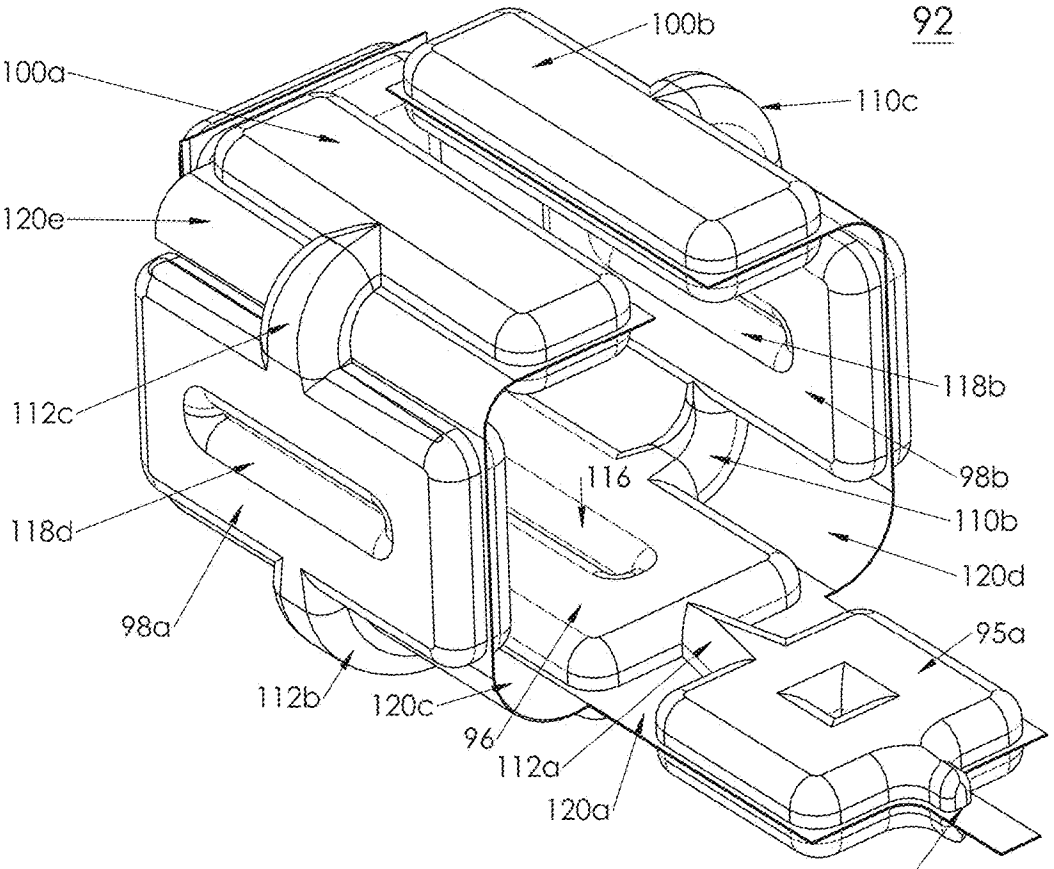
FIG. 6 is a perspective view of the package of FIG. 5 in its completed folded state.
Figure 7:
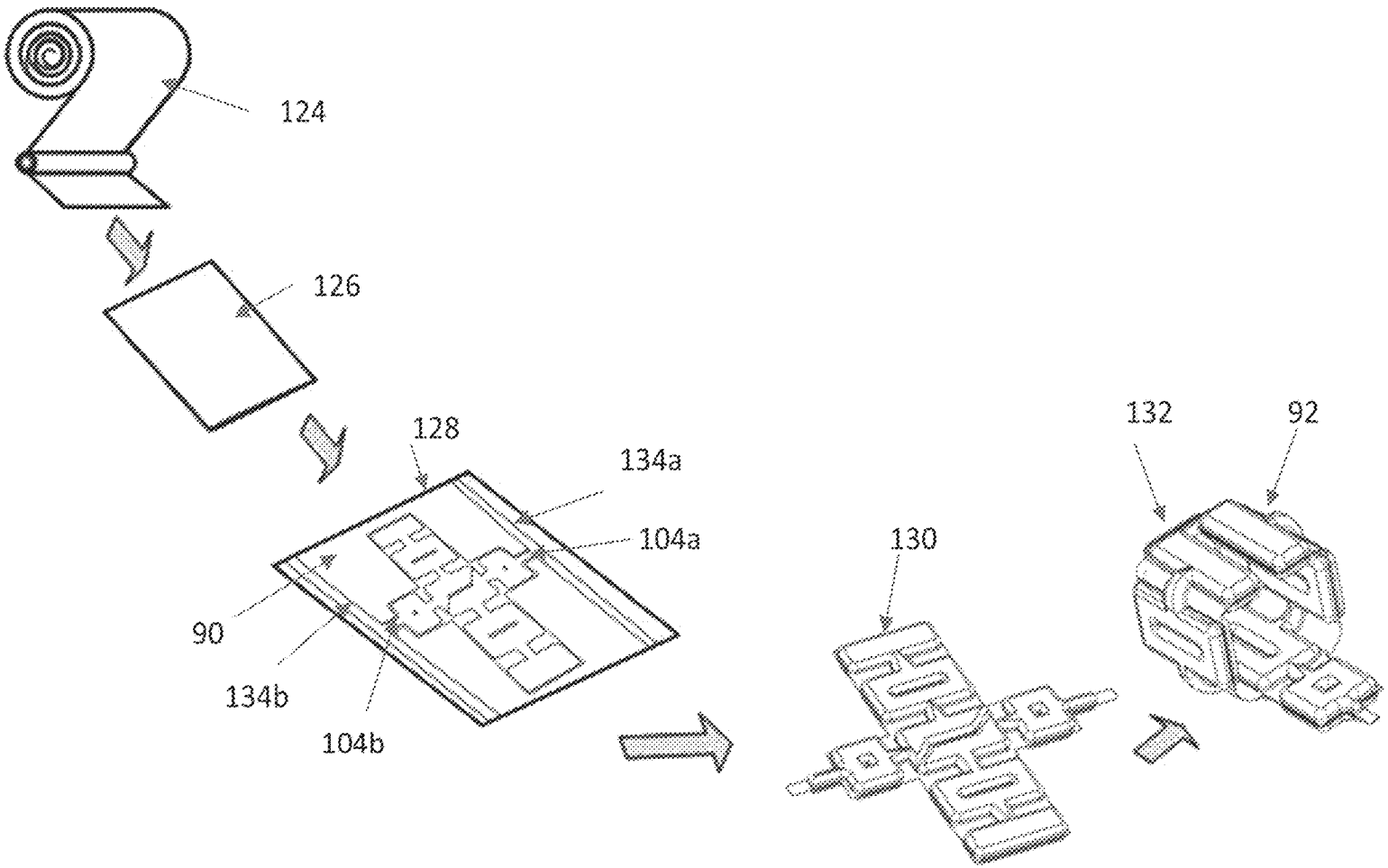
FIG. 7 is a schematic view similar to FIG. 2 for the package of FIGS. 4-6.
Figure 8:
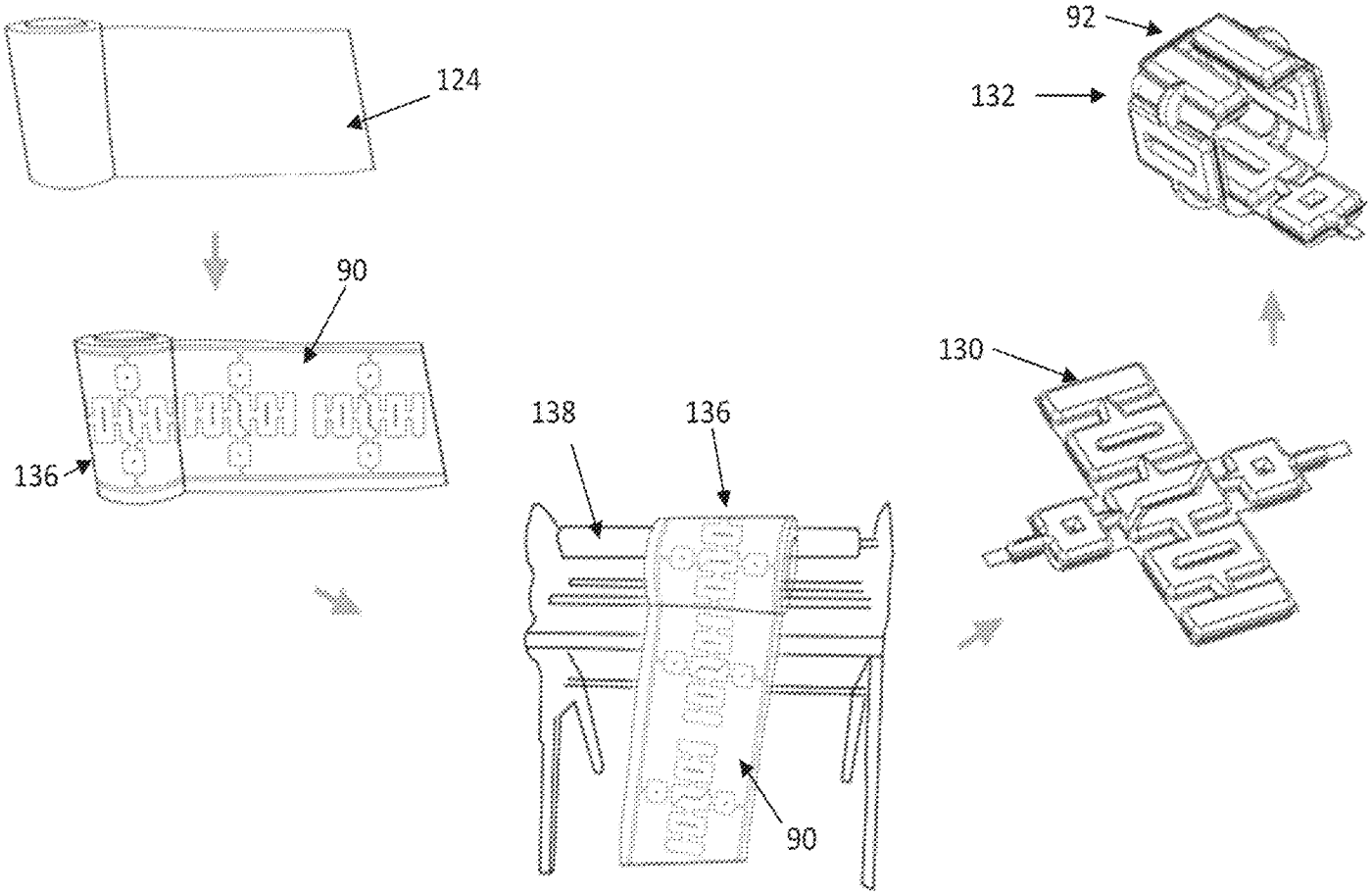
FIG. 8 is a schematic view of a variation of the method of FIG. 7.

Referring now to FIGS. 4-8, there is shown another exemplary embodiment of the invention, in the form of a foldable package. FIG. 4 shows a single package precursor 90, FIG. 5 shows an inflated package 92, and FIG. 6 shows package 92 after folding. FIG. 7 illustrates an exemplary embodiment of a method of manufacturing the package. FIG. 8 illustrates a variation of FIG. 7.

Package precursor 90 does not include nests for receiving the packaged articles to be packaged, but is designed to be folded around the packaged article (as in FIG. 5) thereby providing surrounding cushions. Also, precursor 90 includes separately inflatable compartments 94*a* and 94*b* that are isolated from each other. This provides backup or redundancy protection for the packaged article in case of damage and deflation of part of the package.

Package precursor 90 may be in the form of single sheets for flat storage, or left on a roll, as previously described.

As illustrated in FIG. 4, package precursor 90 includes end panel areas 95*a* and 95*b* which will be folded over the ends of the packaged article, a base panel area 96 which will form a bottom cushion on which an article will be placed, side panel areas 98*a* and 98*b* which will be folded over the sides of the packaged article, and top panel areas 100*a* and 100*b* which will be folded over the top of the packaged article. FIG. 6 shows the final configuration of package 92 but without a packaged article.

It should be recognized that while the embodiment of FIGS. 4-8 is illustrated as having seven panel areas, the precursors and packages can be configured with 2, 4, 5, 6, 7 or more separate foldable panels.

With continued reference to FIG. 4 and also to FIG. 7, package precursor 90 is inflated by separate longitudinally extending inflation manifolds 134*a* and 134*b* (shown in FIG. 7, but without the extended portions described in connection with FIG. 2A) as in other embodiments described herein. Inflation ports 104*a* and 104*b* provide communication between the inflation manifolds 134*a* and 134*b* and the separately inflatable compartments 94*a* and 94*b*, respectively as explained below.

Compartments 94*a* and 94*b* may be configured in various ways. In the illustrated embodiment, a first compartment 94*a* includes end panel site 95*a*, a first part 106*a* of base panel site 96, side panel site 98*a*, and top panel site 100*a*. Compartment 94*b* includes end panel area 95*b*, a second part 106*b* of base panel area 96, side panel site 98*b*, and top panel site 100*b*. Compartment 94*a* is inflated through inflation port 104*a* along an inflation path indicated by arrow 108*a*, and compartment 94*b* is inflated through inflation port 104*b* along an inflation path indicated by arrow 108*b*. Communication between the panels along inflation path 108*a* is provided by connecting passages 112*a*-112*c*. Similarly, communication between the panels along inflation path 108*b* is provided by connecting passages 110*a*-110*c*.

In the illustrated embodiment, isolation between compartments 92*a* and 92*b* is provided, by sealing the first and second parts 106*a* and 106*b* of base panel 96 along lines 114*a* and 114*b*, respectively, and by a bonded area 116 connecting the seal lines 114*a* and 114*b*. Bonded areas 118*a*-118*c*, are also provided in end panels 95*a* and 95*b*, respectively and bonded areas 118*b* and 118*d* are provided in side panels 98*a* and 98*b* respectively as well. Optionally, bonded areas (not shown) may also be provided in top panels 100*a* and 100*b*.

The purpose of bonded areas 118*a*-118*d* is to help maintain the desired inflated shape of the portions of package 92, for example, to prevent the inflated areas from ballooning. Bonded area 116, in addition to serving to separate compartments 92*a* and 92*b*, serves it help shape base panel 96.

To facilitate folding, hinges are formed on precursor 90. As shown in FIGS. 4 and 5, one way to provide the hinges is in the form of un-inflatable areas at the desired fold lines. Thus, in the illustrated embodiment, hinges 120*a* connect end panel area 95*a* and the first part 106*a* of base panel site 96. Hinges 120*b* connect end panel site 95*b* to the second part 106*b* of base panel site 96. Hinges 120*c* connect the first part 106*a* of base panel site 96 to side panel site 98*a*. Hinges 120*d* connect second part 106*b* of base panel site 96 to side panel 98*b*. Hinges 120*e* connect side panel site 98*a* to top panel site 100*a*. Similarly, hinges 120*f* connect side panel 98*b* to end panel site 100*b*. These may be defined by bonded marginal lines, or optionally, the entire hinge areas may be bonded. In FIG. 5, the sealed ends of inflation ports 104*a* and 104*b* are indicated as 122*a* and 122*b*. FIG. 5 also shows representative embodiments in which the inflation manifolds have been trimmed as at 124.

As previously mentioned, inflation of the parts of the packages is maintained by sealing the inflation ports, after which the inflation manifolds and other scrap material. As in precursor 20 (FIG. 1), to facilitate scrap separation, perforations 125 are provided on precursor 90.

It has been found that in some multiple panel configurations, the two layers of film in the panels tend to stick together in the inflatable areas with the result that the panels are sometimes not fully inflated. According to some embodiments, this problem can be alleviated or avoided by tapering the connecting passages between panels they are wider at their upstream ends, i.e., at the connection to the inflation manifolds, and become progressively narrower toward their downstream ends. By way of example, connecting passages that vary in width from about 23-24 to about 12-14 mm have been found to provide satisfactory results.

It should be appreciated that this configuration of the connecting passages may optionally be applied to all the multiple-panel embodiments described herein.

FIG. 6 shows package 92 with all of its panels folded except end panel 100*a*, through which an article may be inserted.

FIGS. 7 and 8 show two variations of methods for forming package 92 according to some embodiments. The progression is the same as in FIG. 2, but includes folding the package 92 at 132. As may also be seen at 128, precursor 90 is shown with the inflation manifolds 134*a* and 134*b*, while at 130, the inflation manifolds have been shown already cut and trimmed.

It should also be understood that perforations like those shown in FIG. 1 (not shown in this embodiment) may be provided to separate the precursor 90 or package 92 from surrounding scrap material, or the inflation line may include a die cutting station.

The variation of FIG. 7 shown in FIG. 8 differs in that precursor 90 is stored as a roll 136 instead of in flat sheets. Also, for completeness, a machine 138 is shown. An exemplary embodiment a suitable machine is shown schematically in, and has been described above in connection with FIG. 3.

An Exemplary Three-Compartment Precursor

Figure 9:
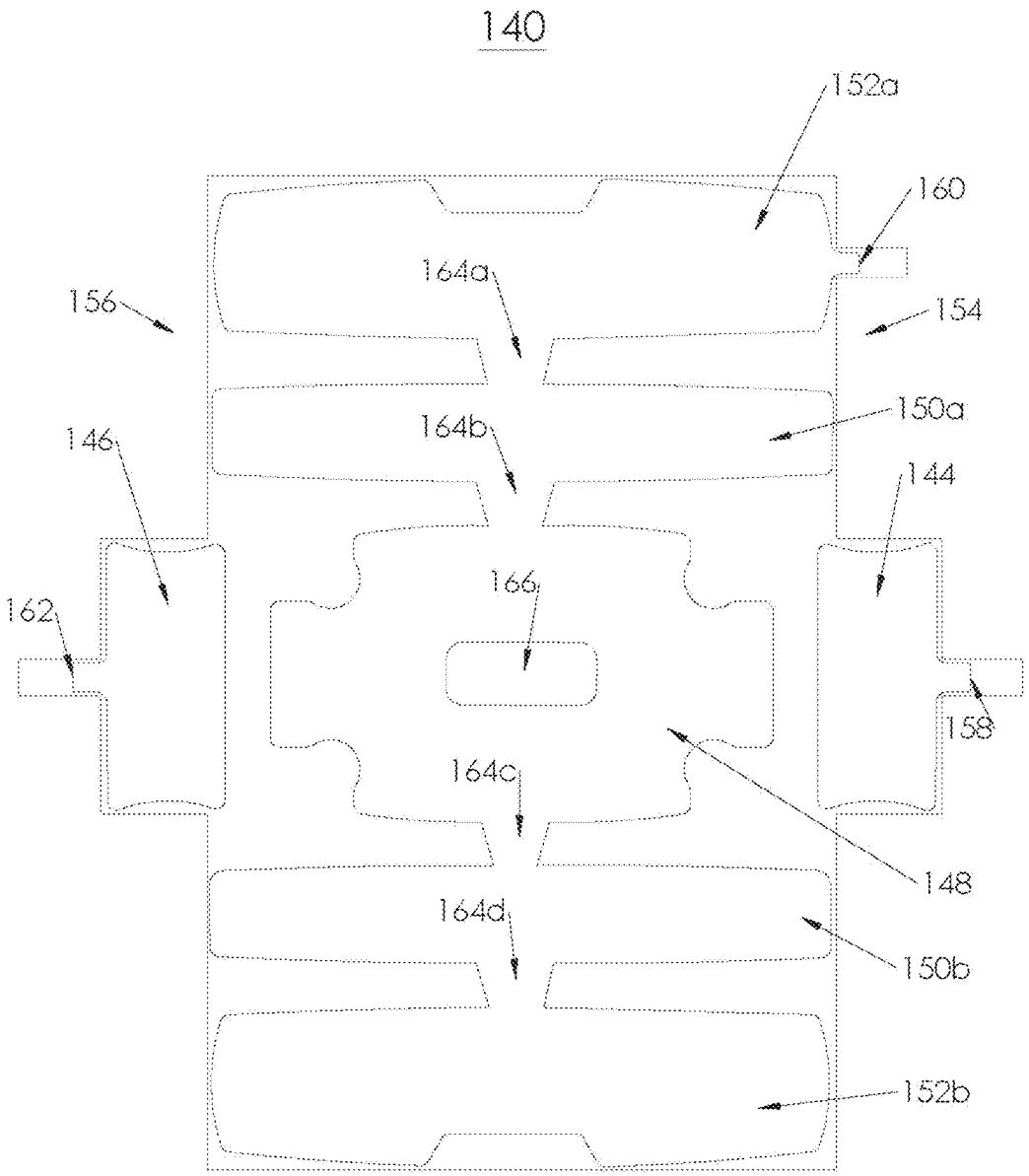
FIG. 9 is a plan view of a package precursor for a foldable package according to another embodiment of the invention.
Figure 10:
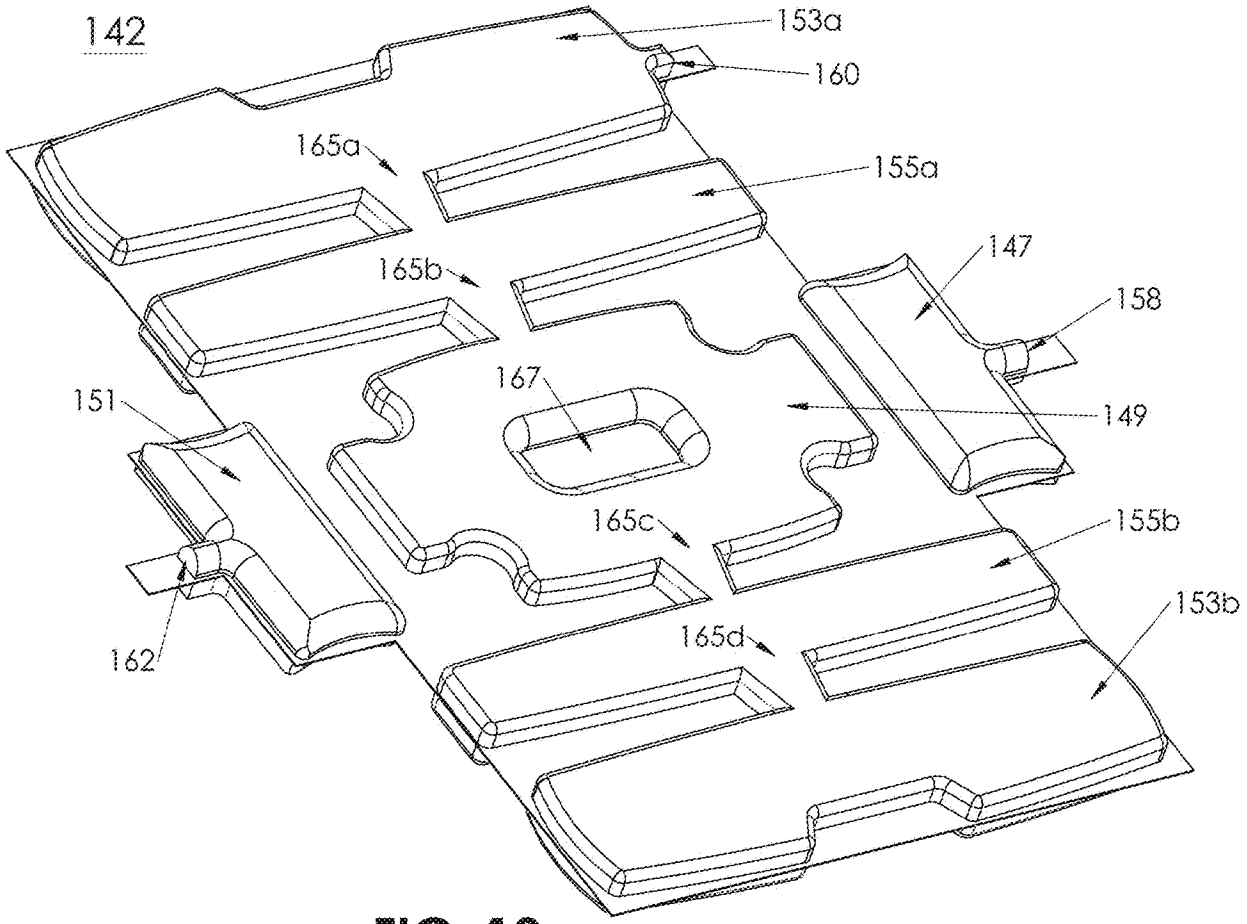
FIG. 10 is a perspective view of an inflated package formed from the precursor of FIG. 9.

FIG. 9 illustrates another embodiment of a precursor 140 for a foldable package according to some embodiments of the invention. FIG. 10 shows an inflated package 142 formed from precursor 140.

In package precursor 140, there are three separate compartments. The first compartment is comprised of end panel 144. The second compartment is comprised of end panel 146. The third compartment comprises the rest of the package, including base panel 148, side panels 150*a* and 150*b* and top panels 152*a* and 152*b*. Inflation of the first and third compartment is by means of an inflation manifold (not shown) that runs alongside 154 of precursor 140. The second compartment is inflated by a second inflation manifold (not shown) that runs alongside 156 of precursor 140. Inflation ports 158 and 160 connect the first and second compartments to their inflation manifold. Inflation port 162 connects the third compartment to its inflation manifold.

As in the embodiment of FIGS. 4-8, package precursor 140 includes a connecting passages 164*a*-164*d* that connect base panel 148, side panels 150*a* and 150*b*, and top panels 152*a* and 152*b*. Connecting passages 164*a*-164*d* may be tapered, as previously described.

In addition, perforations (not shown) may be provided, as in the embodiments of FIGS. 1 and 4.

Also, as in the embodiment of FIGS. 4-8, hinges are formed by un-inflatable areas between the inflatable panels are provided to facilitate folding. In this embodiment, the package is provided with an un-inflatable area 166 in base panel 148. This may serve as a nest, but it will be understood that the various configurations described herein, including a base panel without a nest, may be substituted. Alternatively, un-inflatable area 166 may serve as a shaping area, as previously described.

The resulting package 142, as shown in FIG. 10, includes inflated top panels 153*a* and 153*b*, side panels 155*a* and 155*b*, end panels 147 and 151, and base panel 149, as well as connecting passages 165*a*-165*d*, and sealed inflation ports 158 and 162. Shaping areas or nests as previously described such as shown at 167 may also be provided.

In the foldable packages described above, the hinges are shown as essentially having the same configurations. However, by proper selection of the size and/or placement of the hinges and the width of the connecting passages, the packages may have a tendency to be self-folding.

In particular, connecting passages that are a very narrow compared to the length of the panels, for example between about 5 to about 10 percent of the panel width promote self-folding. Hinges that are substantially wider than the length of the connecting passages, for example, about 2 to about 5 times as wide, and tapered connecting passages as previously described also promote self-folding. It has been found, for example, that the angle of self folding varies from about 180 degrees to about 90 degrees as the width of the hinge areas decrease.

An Exemplary One Manifold-One Compartment Precursor for a Foldable Package

Figure 11:
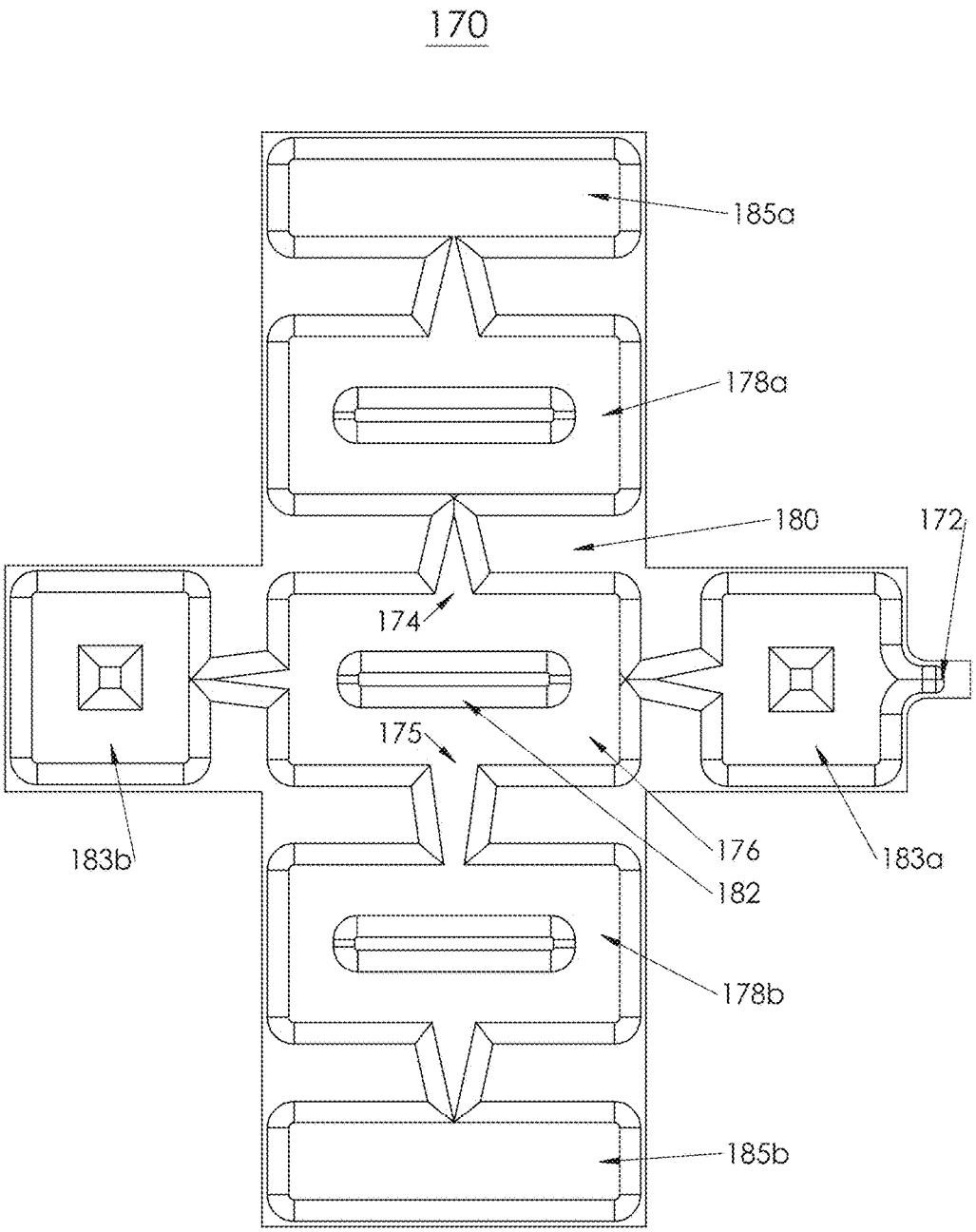
FIG. 11 is a plan view of a package according to another embodiment of the invention.

FIG. 11 shows another embodiment of a foldable package 170 already inflated in which the entire package is inflated by a single manifold (not shown) that runs along one edge, for example, the right edge of the package precursor, and a single inflation port 172. As in previously described embodiments, connecting passages such as passages 174 and 175 connect base panel 176 to side panels 178*a* and 178*b*, and hinges such as 180 between panels 176 and 178 are also provided. As in the other embodiments described herein, the connecting passages may be tapered, and perforations provided on the package precursors to facilitate separation of individual packages from each other, and from scrap material.

Package 170 also includes end panels 183*a* and 183*b*, and top panels 185*a* and 185*b*.

Also in this embodiment, there are also spot or strip welded panel shaping areas such as 182 in base panel 176, as previously described.

Exemplary Precursor Embodiments of Symmetrical Folding Packages

Figure 12:
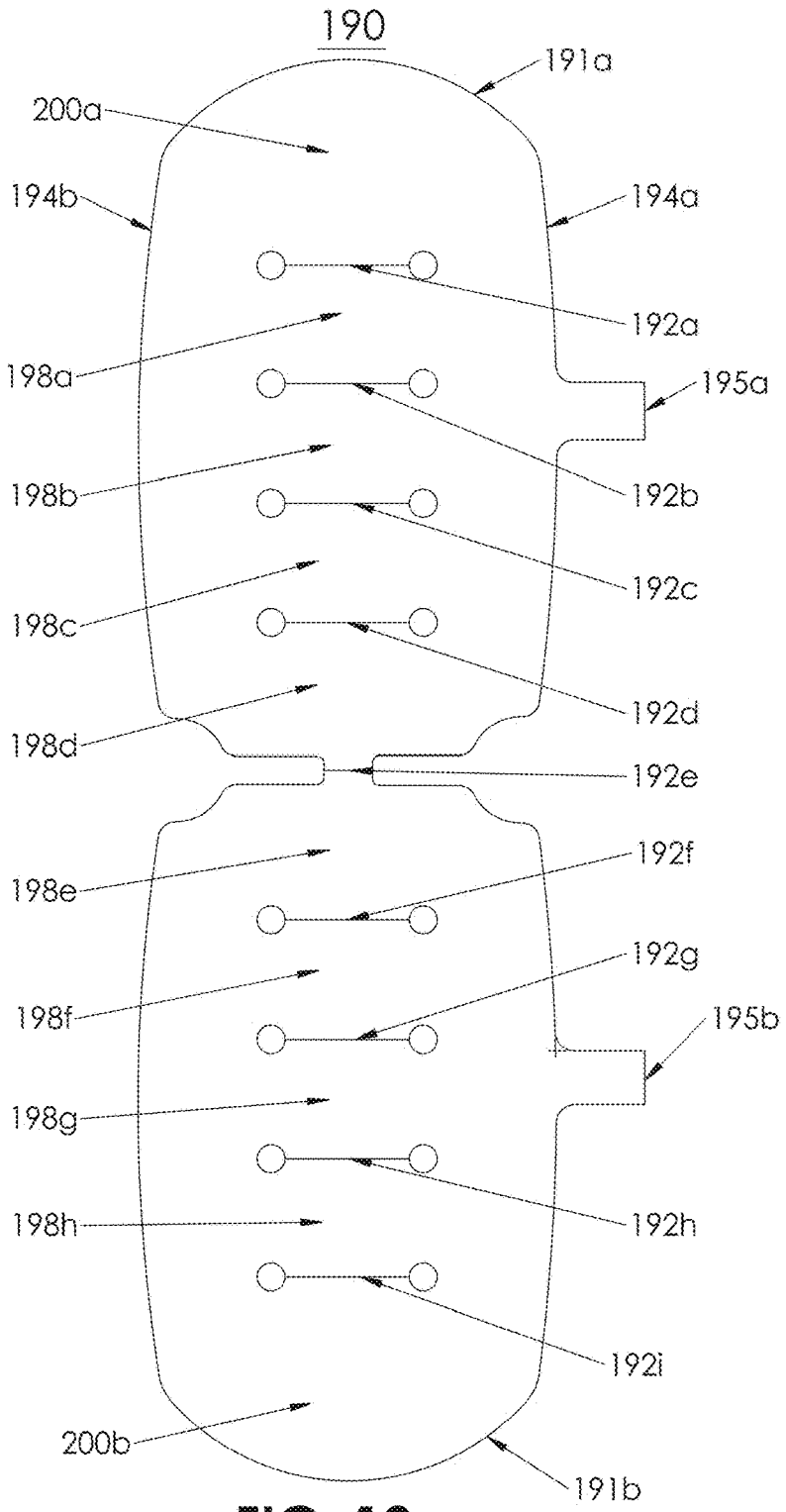
FIG. 12 is a plan view of a precursor for foldable package according to another embodiment of the invention.

FIG. 12 illustrates a package precursor for another embodiment of the invention, generally indicated at 190. Here, the precursor is formed with transverse bond lines 191*a* and 191*b* that define the ends of precursor 190, and transversely extending bond lines 192*a*-192*i* between inflatable end panels 200*a* and 200*b* and intermediate panels 198*a*-198*h*. The longitudinal edges are formed by side bond lines 194*a* and 194*b*. Inflation is provided by longitudinally extending manifolds (not shown) at the sides of precursor 190 and by inflation ports 195*a* and 195*b*.

In this embodiment, inflation ports 195*a* and 195*b* are located at opposite ends on the same side of precursor 190 and are inflated by a single manifold. Alternatively, the inflation ports may be located on opposite sides of precursor 190, and two inflation manifolds may be provided.

The line of symmetry for precursor 190 is formed by hinge on fold line 192*e*, which separates the precursor into two separate compartments. End panel areas 200*a* and 200*b* and intermediate panel areas 198*a*-198*h* are separated by un-inflatable bond lines 192*a*-192*d* and 192*f*-192*i*. These extend only partially across the precursor to allow passage between the panel areas so that only a single inflation port is needed for each compartment.

A package is formed from precursor 190 by folding transversely along fold line 192*e* between intermediate panel areas 198*d* and 198*e* which defines the transverse line of symmetry, and bonding the contacting portions of longitudinal bond lines 194*a* and 194*b*. Alternatively, bond lines 194*a* and 194*b* can be formed after precursor is folded so that the side bonds and the bonded sides of the folded precursor are formed in a single step. The result is a bag sealed at the bottom by bond line 192*e* and open at the top t permit insertion of an article between end panels 200*a* and 200*b*.

As shown end panels 200*a* and 200*b* are wider, i.e., in the longitudinal direction of the package precursor 190, than intermediate panels 198*a*-198*h*. As a result, when the precursor is inflated, end panels 200*a* and 200*b* bulge out and contact each other, making the package self-closing.

Figure 13:
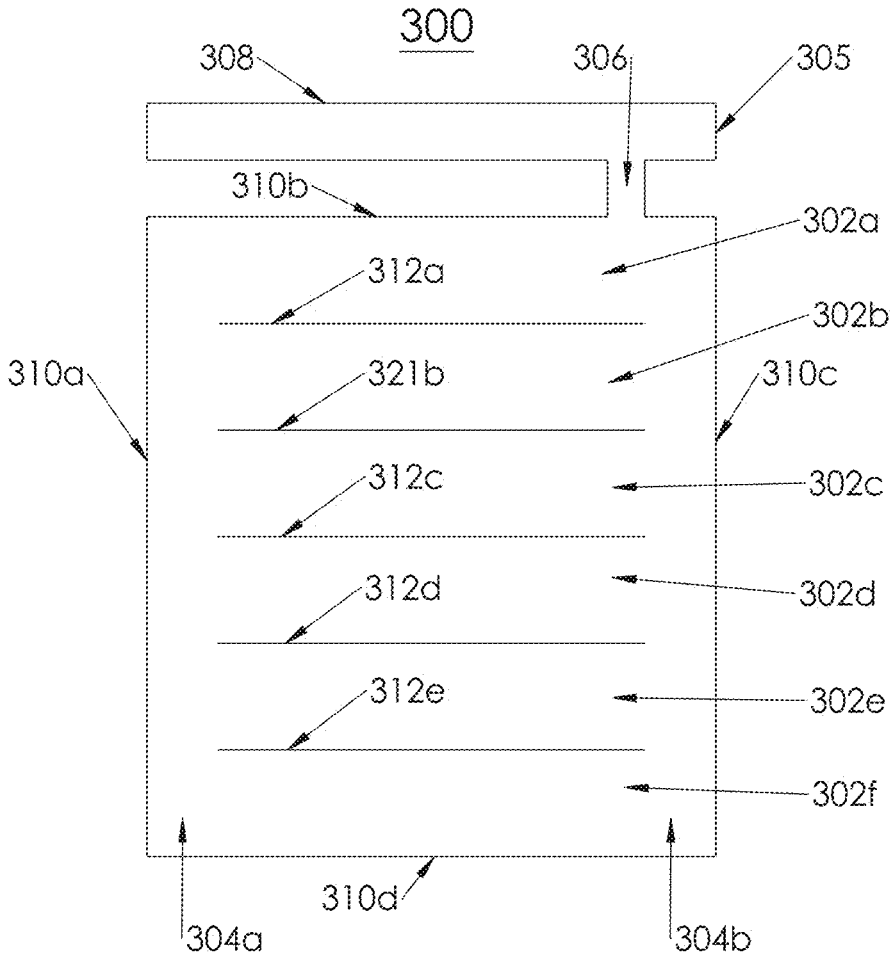
FIG. 13 is a plan view of a precursor for foldable package according to another embodiment of the invention.

FIG. 13 illustrates another embodiment of a symmetrical package precursor 300, which is a variation of precursor 190. Here, inflatable areas 302*a*-302*f* are oriented longitudinally and separated by bond lines 312*a*-312*e*. Ends 304*a* and 304*b* are defined by inflatable areas that extend transversely. As will be understood precursor 300 represents one of a plurality of precursors that may be formed end to end on a sheet or a roll, the upstream end of which is indicated at 305.

The longitudinal and transverse inflatable areas are connected together, and to a single inflation port 306 that is connectable to a source of inflation fluid through an inflation manifold 308. Inflation port 306 is sealed by a bond line or a valve or by adhesive (no shown) after package precursor 300 has been inflated, as described in connection with the other embodiments.

The outer margin of precursor 300 is sealed by bond lines 310*a*-310*d* that extend around the panels and the inflation manifold. Bond line 310*b* also seals the package after inflation manifold 308 has been cut and trimmed, as previously described.

In the illustrated embodiment, the package is formed by two separate like sheets sandwiched together and bonded at their contacting margins. Alternatively precursor 300 may be formed of a single sheet that is folded transversely along a line of symmetry.

In either case, by bonding the appropriate contact edges, a sleeve may be formed. To form a bag, the contacting portions at one end 318*a* are bonded together to form a bottom of the bag, 310*b* and 310*d* are bonded together to form the sides of the bag, and 310*c* is left open to permit insertion of an article to be packaged.

Open end 310*c* may be closed by sealable flaps or oversized end panels 304*a* and 304*b*, as described in connection with the other bag embodiments.

While precursor 300 is formed into a package by folding transversely, it should be appreciated that in an un-illustrated embodiment, the line of symmetry can extend transversely, and the package formed by folding longitudinally.

As another variation, precursor 300 can be formed of separate compartments, and an inflation manifold and inflation port formed for each compartment.

The embodiments just described can be advantageous, as the longitudinal and transverse panels can provide resistance to both transverse and longitudinal bending forces.

Figure 14:
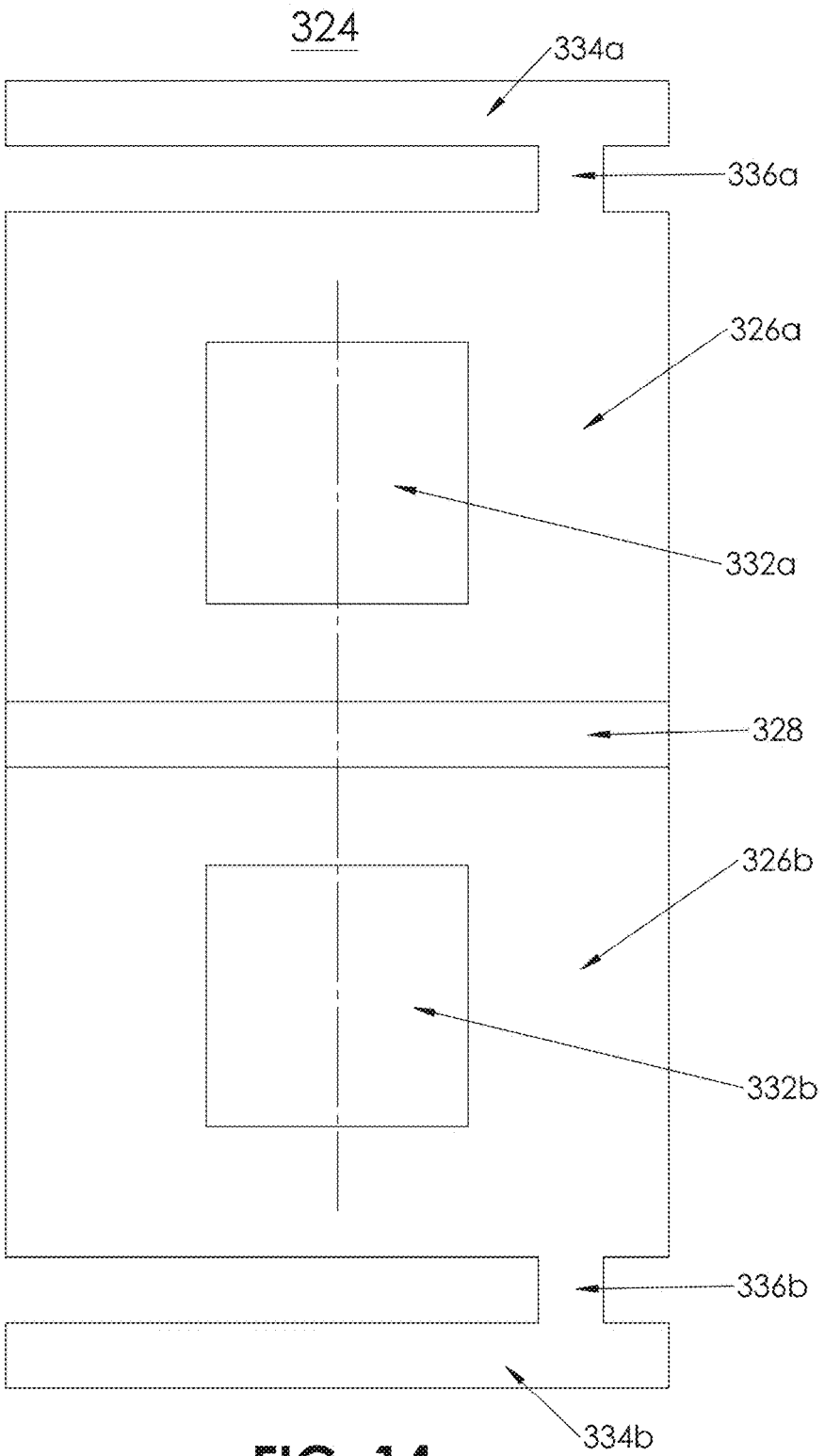
FIG. 14 is a plan view of a precursor for foldable package according to a further embodiment of the invention.

FIG. 14 shows another embodiment of a symmetrical package precursor 324 for a foldable package, that is also a variation of precursor 190. Here, a plurality of precursors 324 may be oriented transversely on a sheet or a roll. Precursor 324 is formed by inflatable areas 326*a* and 326*b* separated by a hinge 328 located at a transverse line of symmetry. Precursor 324 is defined by un-inflatable areas 332*a* and 332*b* surrounded by inflatable areas 326*a* and 326*b*. The interiors of un-inflatable areas 332*a* and 332*b* are removed by perforations or die cutting leaving open spaces.

Package precursor 324 is inflated by two separate inflation manifolds 334*a* and 334*b* that extend longitudinally on the sheet or roll. Inflation ports 336*a* and 336*b* connect inflatable areas 326*a* and 326*b* to the source of inflation fluid through inflation manifolds 334*a* and 334*b*, respectively. As in other embodiments, inflation ports 336*a* and 336*b* are sealed after inflation.

An inflated package formed from precursor 324 is used to cover only corners of a packaged article. It is therefore formed by folding the inflated precursor 90 degrees at hinge 328.

An Exemplary Needle-Inflated Precursor Embodiment

Figure 15:
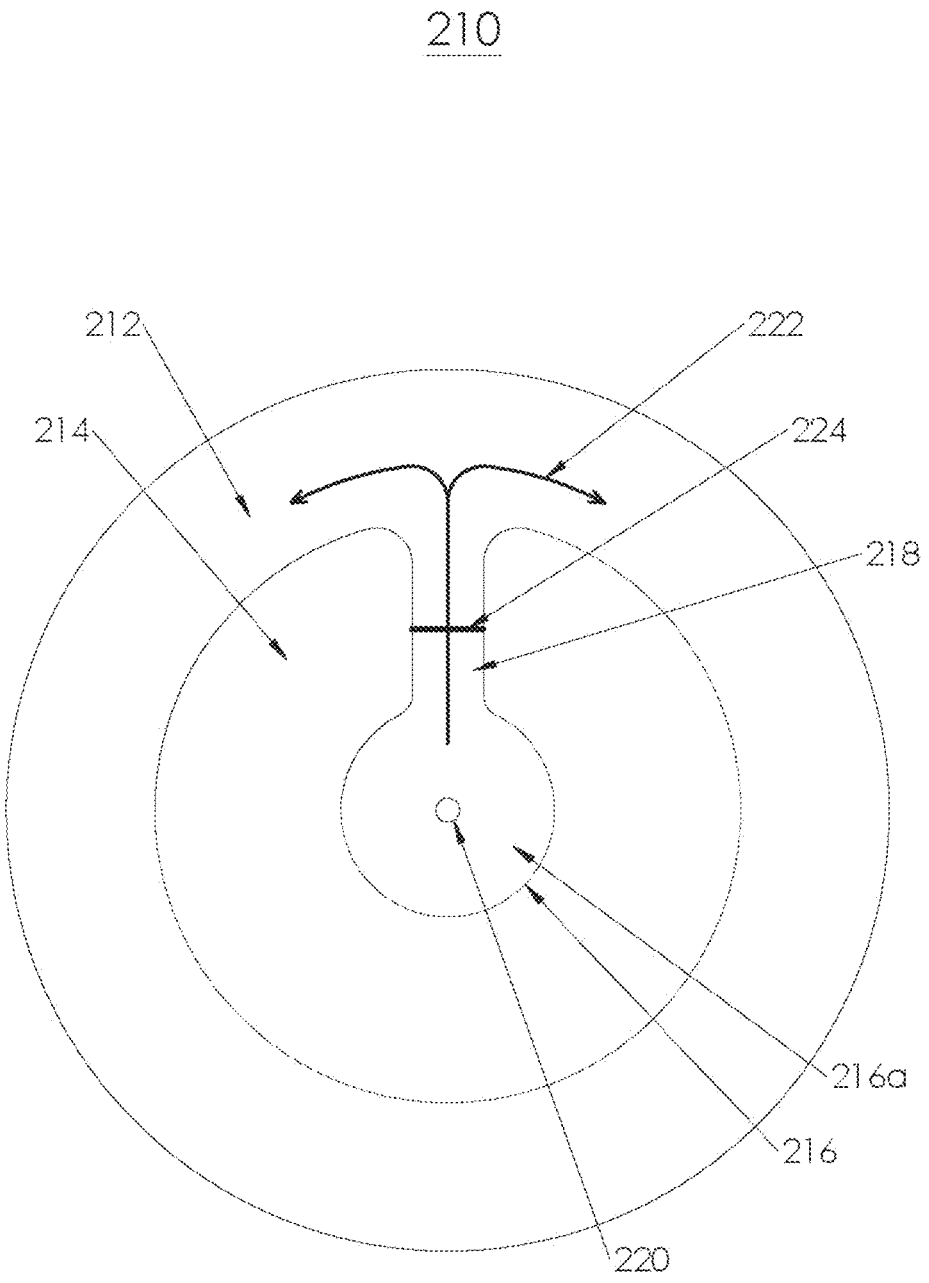
FIG. 15 is a schematic plan view of a way of inflating a package precursor according to some embodiment of the invention.

FIG. 15 illustrates an exemplary embodiment of the invention that uses a different configuration of a package precursor 210 and a method of inflation. A single panel is illustrated for simplicity of description, but it should be understood that multiple panels may be provided in one or more parallel rows along the length of a sheet or roll.

Panel 210 includes an inflatable area 212 surrounding an un-inflatable area 214, which in turn, surrounds an inflation port 216 that is connectable to the source of inflation fluid. Inflation port 216 includes a central inlet area 216*a*, and a connecting passage 218 through which inflation fluid is provided to inflatable area 212.

In this embodiment, inflation fluid is provided through a needle such as used to inflate a basketball, indicated at 220, that pierces inflation inlet area 216*a* for example, from above, i.e., into the plane of the drawing. Alternatively, a preformed opening (not shown) can be provided in inlet area 216*a*.

Inflation fluid passes to inflatable area 212 along the path indicated by arrow 222. After inflation, connecting passage 218 is sealed by a transverse bond line 224 or otherwise as previously described. With this arrangement, inlet area 216*a* does not need to be sealed.

With the embodiment of FIG. 15, multiple needles can be provided so that several panels can be inflated simultaneously using individually controlled inflation pressures.

It will be understood that in other embodiments having multiple inflation ports, several inflatable areas can be inflated simultaneously, as in the case of the embodiments shown in FIGS. 2, 7, 8, and 12.

Figure 16:
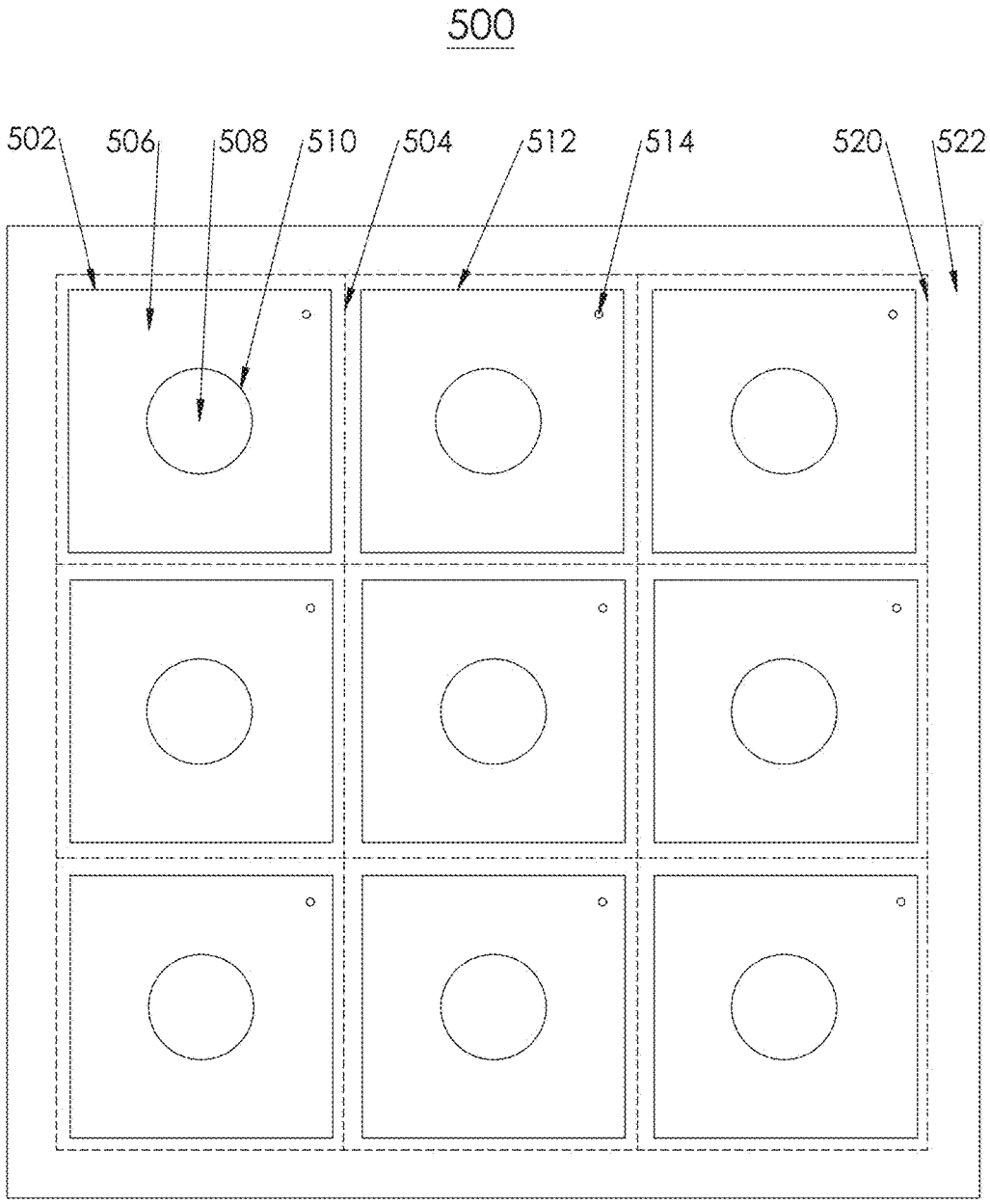
FIG. 16 illustrates a variation of the embodiment of FIG. 15 according to some embodiments of the invention.
Figure 17:
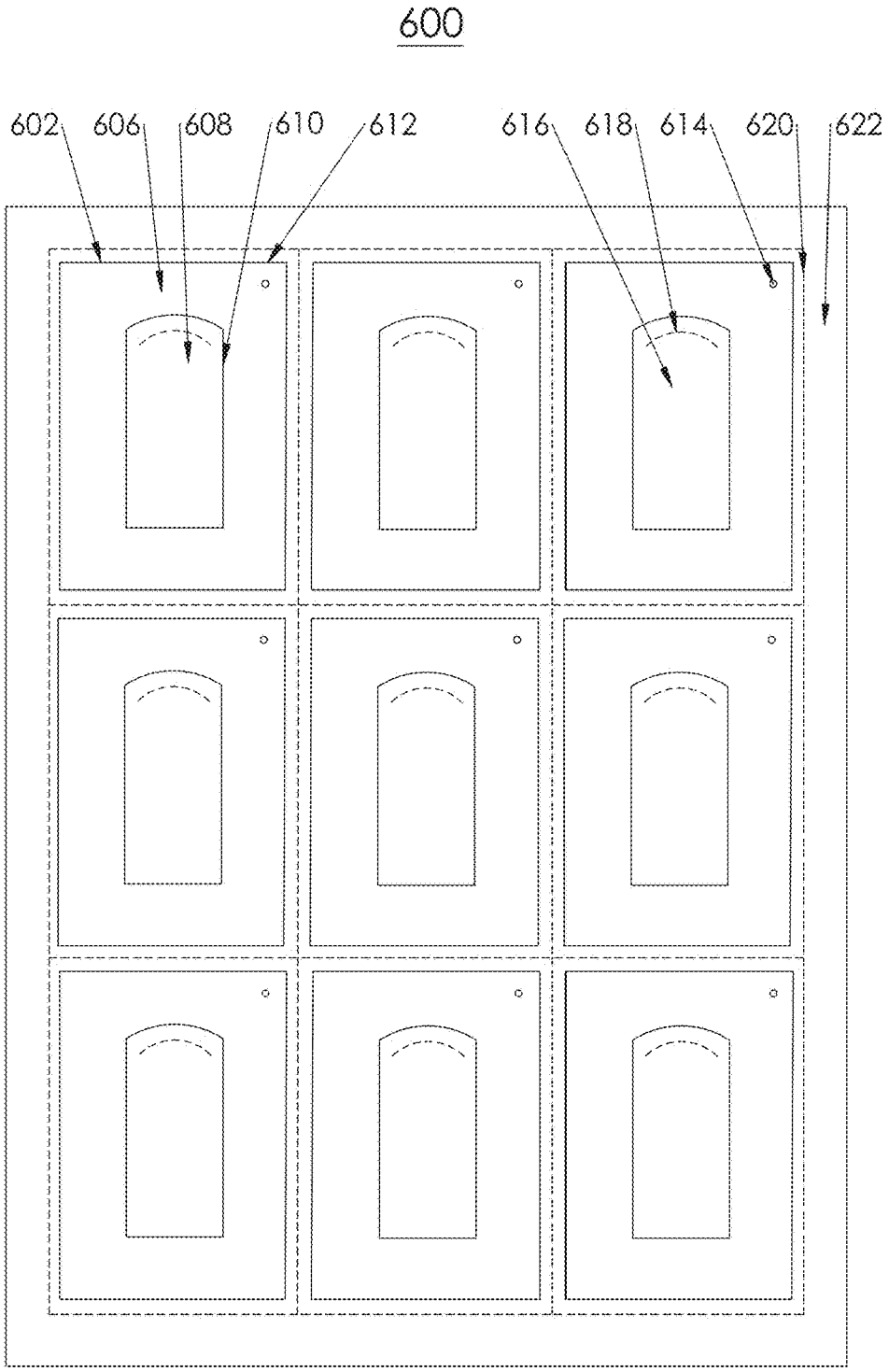
FIG. 17 illustrates another variation of the embodiment of FIG. 15 according to some embodiments of the invention.

FIGS. 16 and 17 are plan views of package precursors with certain parts omitted that illustrate two variations of the embodiment of FIG. 15 according to some embodiments of the invention. The figures show arrays 500 and 600 of article-receiving panel areas 502 and 602, for example, 10×20 panel arrays, or larger or smaller arrays, separated by perforations 504 and 604, respectively. Panel areas 502 are comprised of inflatable areas 506 and un-inflatable areas 508 that form recesses. The margins between inflatable areas 506 and un-inflatable areas 508 are formed by bond lines 510. The outer margins of inflatable areas 506 are formed by bond lines 512.

Similarly, in array 600, the panel areas 602 are comprised of inflatable areas 606 and un-inflatable areas 608. The margins between inflatable areas 606 and un-inflatable areas 608 are formed by bond lines 610. The outer margins of inflatable areas 606 are formed by bond lines 612.

Panel areas 502 and 602 are inflated by individual needles, or by groups of needles (not shown) that inflate groups of panel areas, for example, individual rows transverse to the precursor travel direction through an inflator. The needles enter the inflatable areas though insertion points 514 and 614, shown, by way of example, in upper corners of the inflatable areas. The insertion points may be closed, whereby the needle pierces the top layer of the sheeting as shown, or a pre-formed opening, for example, a small x-shaped slit, may be provided. After inflation, the needle opening may be sealed by spot welding, or by an internal one-way valve, or by an adhesive sticker placed over the opening. In embodiments in which the needle pierces the inflation point, the opening may also be self-sealing by using a thixotropic puncture-preventative fluid such as Tyre Protect™ available from Puncture Safe, Salford, Lanc's UK, or a water-base or glycol-base product such as that available from Viking Seal™, North Tonawanda, N.Y. U.S. or other suitable and desired material as the inflation fluid.

With panel array 500, un-inflatable areas 508 may be welded or left un-welded. The articles may be placed in the resulting recesses before or after inflation.

With panel array 600, the layers of the sheeting that form un-inflatable areas 608 are not welded, so that a pocket 616 is formed to receive the packaged article. An opening 618 is provided for insertion of the article. Advantageously, the article is inserted before inflation, as it may be more easily done at that time.

With the embodiment of FIG. 16, the packaged articles are simply removed from the recesses. For the embodiment of FIG. 17, the articles are most easily removed by puncturing inflatable areas 606.

In both instances, article insertion may be done manually or by machine.

The configurations illustrated in FIGS. 16 and 17 have great versatility in that they can accommodate a wide variety of article configurations by shaping the article-receiving areas of panel areas 502 and 602 according to the shape and size of the article.

In addition, perforations 504 and 604 allow separation of an individual panel, or a row or a column of panels or even a smaller array of panels in the inflated packages. The outer perforations 520 and 620 also allow convenient separation of the precursors or the inflated arrays from surrounding scrap material 522 and 622.

Also, in both embodiments, arrays 500 and 600 form trays of packaged articles can be stacked and then put into a box for shipment.

Figure 18:
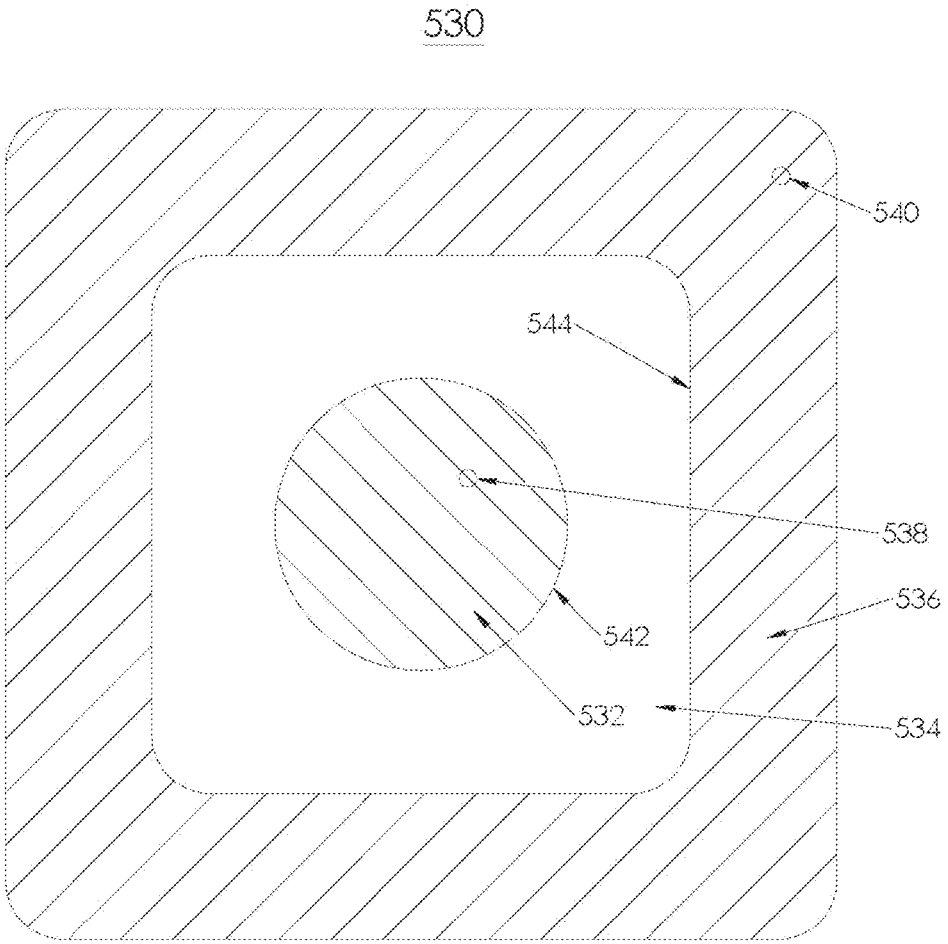
FIG. 18 illustrates a variation of the embodiment of FIG. 16 according to some embodiments of the invention.

FIG. 18 illustrates a variation of the needle-inflated embodiment of FIG. 16 according to some embodiments of the invention. In this embodiment, an individual article receiving area 530 is formed with an internal cushion 532 inside an un-inflatable area 534, and a surrounding outer cushion 536

The inflatable areas 532 and 536 are individually needle-inflated through respective inflation points 538 and 540 as in precursor 500, and sealed in the same manner as well. With this arrangement, no connecting channels or manifolds of any kind are required.

The non-inflatable area 534 between internal cushion 532 and external cushion 536, defined by inner marginal bond 542 and outer marginal bond 544 holds the two inflatable areas together. As will be recognized, a marginal bond also forms the margin of inner inflatable area 532.

Since inflatable areas 532 and 536 are independently inflated, different inflation pressures may be employed if desired.

Figure 19:
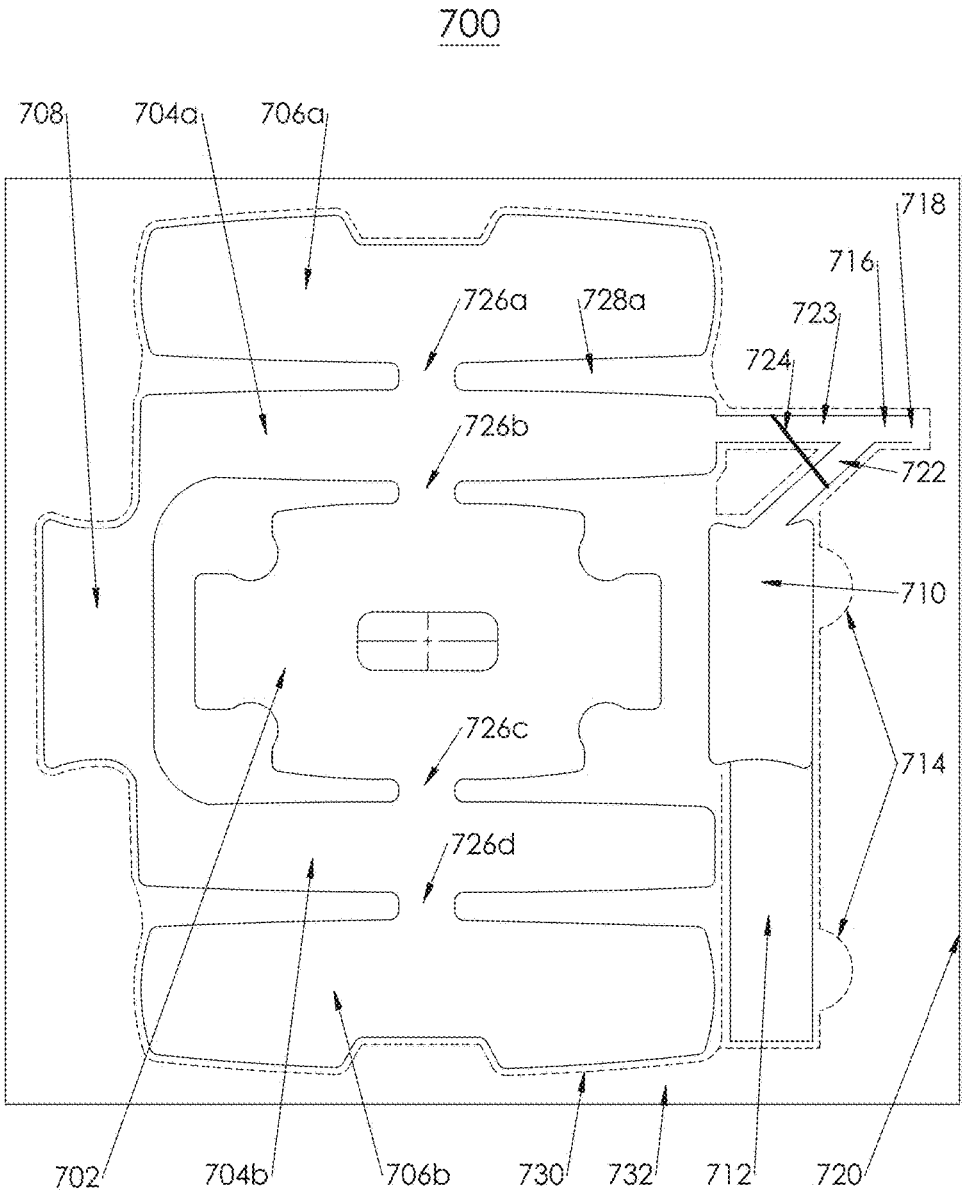
FIG. 19 illustrates a variation of the embodiment of FIGS. 9 and 10 according to some embodiments of the invention.

FIG. 19 illustrates another embodiment of a foldable package precursor 700 designed to accommodate an article having a sharp projection. Precursor 700 is similar to precursor 140 shown in FIG. 9, and the resulting package is similar to package 142 shown in FIG. 10.

Precursor 700 forms a package that includes two separate compartments. The first compartment is comprised of all the foldable panels, namely base panel 702, side panels 704*a* and 704*b*, top panels 706*a* and 706*b*, and one end panel 708 on one side of the precursor (on the left side in FIG. 19). A second separately inflated end panel 710 (on the right side in FIG. 19) is configured as a cushion to accommodate a sharp projection of the packaged article.

Precursor 700 further includes an un-inflatable flap 712 to protect end panel 710 from damage by the projection of the packaged article. Flap 712 is folded over end cushion 710 prior to inflation, and includes a pair of tabs 714 that are aligned after flap 712 ha been folded over end cushion 710. Tabs 714 are heat welded or otherwise bonded to each other to secure flap 712 to end cushion 710.

FIG. 18 illustrates a precursor for a single package. It should be understood, however, that any desired number of like or differently configured precursors may be arrayed longitudinally on a roll of sheeting or a single sheet.

As previously noted, end cushion 710 is a separately inflated compartment from the other panels. A feature of the embodiment illustrated in FIG. 18 is that both compartments are inflated by a single inflation port 716. The inlet end 718 of inflation port 716 is attached to an inflation manifold (not shown) that extends along one longitudinal edge 720 of precursor 700. Downstream of inlet 718, inflation port 716 branches to form an inflation path 722 for end cushion 710, and a separate inflation path 723 for the rest of precursor 700.

Another feature illustrated in FIG. 19 is that with the two compartments being inflated simultaneously, both branches of inflation 716 may be sealed in a single welding operation, for example, by a bond line 724 that extends transversely across both inflation paths 722 and 723. It should be understood, however, that separate inflation ports and inflation manifolds may be provided on opposite sides of precursor 700 if desired, for example if a different inflation pressure is to be employed for end panel 710 than for the other panels.

As in the embodiment of FIGS. 9 and 10, precursor 700 includes connecting passages 726*a*-726*d* between the panels of the main compartment. Although not so illustrated, connecting passages 726*a*-726*d* may be tapered, as previously described. Also, as in the other foldable package embodiments described herein, un-inflated hinges such as hinge 728*a* are provided to facilitate folding of the package.

Perforations 730 are provided, as in the other embodiments described herein to separate the precursor from surrounding scrap material 732.

Other Precursor Configurations

As will be understood from the embodiments described above, packages according to the invention have un-paralleled versatility. For example, in some un-illustrated embodiments, rolls or sheets may carry adjacent precursors that are configured to be cut apart to provide top and bottom covers only for a packaged article.

In another un-illustrated embodiment, precursors can be formed in which the inflated areas on one side are different than those on the opposite side. For example, the inflatable areas on one side can be made larger on a first side than those on an opposed second side, so that the inflated areas extend outwardly from a plane of the package further on the first side. Such packages may be positioned side by side vertically in an outer container with first sides in contact with the sides of the containers and first sides facing second sides of the intervening packages with packaged article between them. Packages configured in this manner may occupy less space in the container.

In a further un-illustrated embodiment, the inflatable areas on opposite sides are staggered transversely or longitudinally so that the inflated areas of the packages interleave when placed in an outer container, again providing a package that occupies less space.

In yet other un-illustrated embodiments, the precursors can be configured so that projecting portions of articles are positioned in contact with un-inflated portions of the package. For example, the areas of contact may be located between inflated areas, or un-inflated pockets can be formed within the inflated areas where projecting portions are located. Such configurations can be advantageous in cases where sharp areas of the projecting portions might pierce the package. By configuring the package so the sharp areas are not in contact with inflated parts of the package, the possibility of deflation is reduced.

From the foregoing description, it will be appreciated that a wide diversity of other package configuration are possible within the embodiments of the invention. These include, without limitation, foldable or non-foldable packages having one or more nest areas configured to receive irregularly shaped articles, foldable package side panels formed in two or more sections, and packages with inflated extensions sized and configured so that a single package occupies and entire outer shipping container.

It should also be understood that the inflator described in connection with FIGS. 3A and 3B may be standalone devices, or may be part of a multi-station processing line. This can include an article insertion station, either upstream or downstream of the inflator, and a separator station for separating successive packages after inflation and before or after article insertion, a folding station for foldable packages, a sealing station for sealable bags as described herein, a loading station for inserting the packages into an outer container such as a shipping box, etc. Several package embodiments described herein include different configurations opposite sides. These may lend themselves to automated loading to increase the speed the packaging process.

It is also expected that during the life of a patent maturing from this application, techniques and materials not explicitly mentioned herein may be developed that are suitable for use in connection with and to come within the scope of various embodiments of the invention.

As used herein the term "about" refers to a range of ±10%.

The terms "comprises", "comprising", "includes", "including", "having" and their conjugates mean "including but not limited to". This term encompasses the terms "consisting of" and "consisting essentially of".

As used herein, the singular form "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicated number and a second indicated number and "ranging/ranges from" a first indicated number "to" a second indicated number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A package precursor for an inflatable package comprising:

a plurality of panels defined by inflatable and un-inflatable areas, wherein the panels have edges, the precursor having the form of an open box, the panels being foldable together to meet at respective edges to form said package in a box shape; and an inflation port that provides inflation fluid to the inflatable areas, wherein the inflation port includes an inlet area connectable to a source of inflation fluid for inflating the panels, wherein the inflation port is heat-sealable after inflation of the precursor, wherein the panels comprise first and second sheets defining outer walls of said inflatable areas, said first and second sheets respectively being multi-layered, the package precursor comprising a manifold containing said inlet area and said inflation port, said manifold extending along a length of one of said edges, said manifold being removable upon sealing said inflation port to leave said panels inflated.

2. A package precursor as defined in claim 1, wherein the panels include article receiving areas comprised of at least some of said un-inflatable areas, or comprised of separate inflatable areas within the panel forming a cushion for the articles.

3. A package precursor as defined in claim 2, wherein each cushion receives inflation fluid from its own inflation port.

4. A package precursor as defined in claim 2, wherein the article-receiving areas of the panels include top and bottom surfaces within the margins of surrounding inflatable areas, and wherein the article-receiving areas are configured to receive an article to be packaged between the top and bottom surfaces through an opening in the surrounding inflated areas, or wherein the un-inflated parts of the article-receiving areas have no top or bottom surfaces.

5. A package precursor as defined in claim 1, wherein the inlet area is configured to receive a needle through which the inflation fluid is provided, or wherein the inlet area is configured to receive the needle between the layers of polymer sheeting defining the inflation port.

6. A package precursor as defined in claim 5, wherein a layer of a polymer sheeting defining the inlet area is configured to be punctured by the needle, or includes a preformed opening through which the needle is inserted, or wherein the inflation port is configured to be sealed by an adhesive sticker over a needle-receiving opening or by a one-way valve, or by spot welding or by using a tire puncture-preventative material as the inflation fluid.

7. A package precursor as defined in claim 1, wherein a separate inflation port provides inflation fluid to each inflatable area, or an inflation port provides inflation fluid to more than one, but less than all the inflatable areas, or a single inflation port provides inflation fluid to all of the inflatable areas.

8. A package precursor as defined in claim 1, wherein the panels are arrayed longitudinally and transversely on the precursor, and said inflation port for the panels is connectable to a source of inflation fluid by the manifold on the precursor, and/or wherein adjacent panels are connected to manifolds located on opposite longitudinal edges of the precursor by separate inflation ports, or wherein the panels are connected in parallel to a source of inflation fluid by at least one connecting passage or are connected in series by passages between upstream and downstream panels, and/or wherein some of the panels are inflated to different pressures from other panels, or wherein the panels are arranged longitudinally on a flat sheet or a roll, and longitudinally adjacent panels are configured differently to form top and bottom covers for a packaged article.

9. A package precursor as defined in claim 8, wherein the connecting passages are inwardly tapered from their respective upstream ends toward their downstream ends, and/or, wherein the connecting passages vary in width from about 23-24 mm. at their upstream ends down to about 12-14 mm. at their downstream ends.

10. A package precursor as defined in claim 1, including one member of the group consisting of:

un-inflated areas that are located and configured to form areas adapted to receive projections of a packaged article in a package formed by inflating the precursor; and inflatable areas on one side of the precursor that are staggered transversely or longitudinally relative to inflatable areas on an opposite side so that the inflated areas of the multiple packages interleave when placed in an outer container.

11. A package precursor as defined in claim 1, wherein the panel areas are comprised in two separate compartments.

12. A package precursor as defined in claim 11, wherein a single inflation port provides inflation fluid for inflating the two compartments.

13. An inflated package formed from a precursor as defined in claim 1, wherein the inflation fluid is one or more of argon, SF6, propane, butane, freons, hydro fluoro carbons (HFC), and a combination of fluids that react to form a foam.

14. A stack comprising a plurality of the package precursors of claim 1.

15. A precursor for an inflated package comprising:

a plurality of inflatable areas defining panels in a package formed from the precursor, the inflatable areas defined between first and second sheets of said precursor, said first and second sheets respectively being multi-layered, the package having the form of an open box having edges, the panels foldable together to form a box shape; and one or more inflation ports connected to the inflatable areas and connectable to a source of inflation fluid, wherein adjacent inflatable areas are separated by un-inflated fold lines forming hinges along which the inflated panels can be folded to be at least partially wrapped around a packaged article, wherein the precursor comprises at least one manifold containing the one or more inflation ports, the at least one manifold extending along a length of one of the edges, the manifold being removable following sealing of the one or more inflation ports.

16. A package precursor as defined in claim 15, wherein the panels are self-folding after inflation.

17. A package precursor as defined in claim 15, wherein:

panels are arranged transversely on the precursor, with hinges running longitudinally between panels, and longitudinally on the precursor, with hinges running transversely between panels; and wherein opposing edges of panels running longitudinally are folded to each other and bonded together when an inflated package is formed from the precursor, thereby forming the sides of a sleeve.

18. A package precursor as defined in claim 15, wherein the hinge areas and the inflatable areas are configured so that part of a package formed by inflation of the precursor is foldable to cover a corner of an article.

19. A stack comprising a plurality of package precursors for an inflatable package, each precursor comprising:

a plurality of panels having edges and defined by inflatable and un-inflatable areas, the package precursor having the form of an open box wherein the panels are foldable together to meet at respective edges to form a box shape;

a manifold; and an inflation port in said manifold that provides inflation fluid to the inflatable areas, wherein the inflation port includes an inlet area connectable to a source of inflation fluid for inflating the panels which inflation port is heat-sealable after inflation of the precursor, the manifold extending along a length of one of the edges, the manifold being removable after sealing to leave said panels inflated.

20. A package precursor as defined in claim 19, wherein said panels comprise two layers of polymer film, or an extruded polymer sleeve, or a single folded sheet of polymer film having bonds in selected areas to define margins of inflated areas.

21. A package precursor as defined in claim 20, wherein the film is comprised of multilayers of polyethylene and polyamide or polyolefin, and/or wherein one of the polymer layers includes an additive selected as defined in requirements of the article to be packaged, and/or wherein the additive provides anti-static properties or anti-corrosive properties or includes a preservative for perishable foods for a package formed from the precursor, and/or wherein the thickness of the polymer sheeting is in the range of about 25 to about 400 microns.

22. An inflated package comprising:

a plurality of panels defined by inflated and un-inflated areas, the panels having edges and forming an open box shape that folds together to form said package as a box shape; and an inflation port that provides inflation fluid to the inflatable areas, wherein the inflation port includes an inlet area connected to a source of inflation fluid for inflating the panels, which inflation port is heat-sealed, the inflation port being part of a tab extending along a length of one of said edges.

* * * * *